US005285828A

United States Patent [19]

Mihail et al.

[11] Patent Number: 5,285,828

[45] Date of Patent: Feb. 15, 1994

[54] APPARATUS FOR INTRODUCING FILLER MATERIAL INTO CONTAINERS

[75] Inventors: Stavros Mihail, Seattle; Marvin I. Berg, Tacoma, both of Wash.

[73] Assignee: Promation Incorporated, Seattle, Wash.

[21] Appl. No.: 890,560

[22] Filed: May 28, 1992

[51] Int. Cl.[5] ..... B65B 39/12

[52] U.S. Cl. ..... 141/71; 141/144; 141/81; 141/137; 141/147; 210/166; 222/170; 100/90; 100/110

[58] Field of Search ..... 141/1, 12, 65, 67, 71, 141/81, 98, 137, 144, 145, 146, 237-239; 210/166; 222/168.5, 170, 189, 190, 205, 217, 252, 330, 346, 370; 406/168, 171; 100/90, 110

[56] References Cited

U.S. PATENT DOCUMENTS

| | | | |
|---|---|---|---|
| 1,667,991 | 5/1928 | Russell . | |
| 2,127,393 | 8/1938 | Doney . | |
| 2,562,815 | 7/1951 | Oscroft . | |
| 2,564,969 | 8/1951 | Goldberg . | |
| 2,939,407 | 6/1960 | Keathley, Sr. et al. . | |
| 3,186,140 | 6/1965 | Bogdanovich . | |
| 3,217,944 | 11/1965 | Bell et al. . | |
| 3,258,041 | 6/1966 | Lau | 141/10 |
| 3,513,626 | 5/1970 | Zhavoronkova et al. . | |
| 3,557,847 | 1/1971 | Hebel et al. | 141/54 |
| 3,592,319 | 7/1971 | Rousseau et al. . | |
| 3,695,486 | 10/1972 | Warner . | |
| 3,780,490 | 12/1973 | Schack et al. | 53/122 |
| 3,820,194 | 6/1974 | Theisen . | |
| 3,864,891 | 2/1975 | Piereder . | |
| 4,068,008 | 1/1978 | Orchard . | |
| 4,230,195 | 10/1980 | Graffin | 177/1 |
| 4,373,560 | 2/1983 | Elsworth | 141/129 |
| 4,549,584 | 10/1985 | Morin et al. | 141/73 |
| 4,582,103 | 4/1986 | Piereder | 141/238 |
| 4,789,016 | 12/1988 | Mihail | 141/144 |
| 4,830,068 | 5/1989 | Langenhahm | 141/237 X |
| 4,884,601 | 12/1989 | Hatakyama | 141/71 |
| 4,893,660 | 1/1990 | Berg et al. | 141/144 |
| 4,961,446 | 10/1990 | Berg et al. | 141/144 |

FOREIGN PATENT DOCUMENTS

| | | |
|---|---|---|
| 0229995 | 7/1987 | European Pat. Off. . |
| 841292 | of 0000 | France . |

*Primary Examiner*—Ernest G. Cusick

[57] ABSTRACT

An apparatus for introducing filler material in a fluid carrier into a measuring chamber in rapid succession is described. The apparatus includes a delivery subsystem for introducing the filler material into the fluid carrier. The delivery subsystem provides the fluid carrier and filler material to a diverter subsystem which separates the stream into two separate streams. The two separate streams are directed into a rotating concentrator subsystem that separates the fluid carrier from the filler material and compresses the filler material. The filler material is further compressed and dewatered in a taper subsystem and drain subsystem. The filler material is then dispensed from the drain subsystem into a measuring chamber where it is cut by a knife plate that includes two blades with overlapping cuts. The apparatus is capable of introducing controlled weights or volumes of filler material into a measuring chamber at high speeds.

30 Claims, 14 Drawing Sheets 25
41
43
45
47
49
51
55
53
12
57
224
147
37
114'
27
29
31
33
35
39

31
3
145
232
235
233
231
245
223
269
273
255
267
263
261
187
185
8
191
183
189
237
257
283
285
225
256
340
265
209
241
247
219
271
252
254
343
249
229
227
251
97
143
239

APPARATUS FOR INTRODUCING FILLER MATERIAL INTO CONTAINERS

FIELD OF THE INVENTION

The present invention relates generally to container filling systems and, more particularly, to systems for introducing controlled volumes or uniform weights of filling material into containers.

BACKGROUND OF THE INVENTION

In numerous applications, bulk quantities of material are required to be dispensed into containers for distribution to a consuming public. For example, in the fish processing industry, portions of butchered fish having their heads, fins, and entrails removed are often commercially distributed in hermetically sealed cans. The result is a conveniently sized product having a relatively long storage life. Because government regulations set maximum acceptable deviations between the actual and advertised product weights, it is necessary to ensure that some minimum weight of the butchered fish is inserted into each can. Given the relatively high volume of cans processed in this industry, even slight variations in container weight over the acceptable minimum are undesirable. More particularly, over the course of a production run, these weight variations cumulatively represent a significant raw material cost to the processor.

In addition to the raw material cost involved in the production of "overweight" cans, several inefficiencies in the speed of processing are typically present in conventional container filling systems. For example, if the weight of the initial portion of butchered fish introduced into a can is below the level accepted by government regulation, an additional operation is required to bring it up to weight. This process is both time consuming and costly, particularly where the weight of a significant percentage of filled cans must be adjusted. Another inefficiency results when the container filling system experiences inherent delays caused, for example, by the inequality of time required to perform various sequential operations. As will be appreciated, in applications where millions of containers are to be filled, even slight delays in the time required to process a single container presents substantial inefficiencies.

Although its influence on a processing industry may be less direct than the inefficiencies noted above, in certain applications the dispensed material may vary considerably in attractiveness from one container to the next. For example, when butchered fish are canned with conventional equipment, large, unattractive pieces of skin may be left exposed on the upper surface of some cans when opened. In addition, the orientation of the meat, or direction of its grain, may vary considerably throughout the can, failing to present the image of a substantially uniform, single piece of meat.

Lastly, the incidental presence of skin or bones around the flange of the can may prevent the can from being properly sealed. As will be appreciated, the resulting seam defect prevents a vacuum from being maintained within the can and will eventually contribute to the spoilage of the contents. Because of the health hazard presented by such spoilage, the production of even a small percentage of containers with seam defects is to be avoided. In light of these observations, there has been a need to produce a system for use in the high-speed filling of containers with accurate weights and volumes of material, while simultaneously providing a more attractive and safe container fill.

In response to the need, applicants of the present invention developed a container filling system that is described in U.S. Pat. No. 4,893,660. A modification of that system for introducing filler material of an amorphous nature into containers is described in U.S. Pat. No. 4,961,446. Although such systems provided more desirable high-speed filling of containers compared to prior systems, they did not take full advantage of their design and were less than satisfactory in addressing the entirety of the problems associated with the prior devices. Accordingly, there continues to be a need for a system that would address each of the prior problems for use in high-speed filling of containers with accurate weights and volumes of material.

SUMMARY OF THE INVENTION

The present invention is an improvement in container filling systems such as those described in U.S. Pat. Nos. 4,893,660 and 4,961,446. The improvement relates to the system used to introduce the filler material into measuring chambers. The system provides the filler material in a uniformly compressed form that can be easily and reliably dispensed into a measuring chamber.

The apparatus formed in accordance with the present invention in one aspect includes a rotating diverter subsystem for separating filler material in a fluid carrier into at least two separate streams. These two separate streams are delivered to a rotating concentrator subsystem that separates the filler material from the fluid carrier and compresses it. The concentrator subsystem includes an elongate inner tube located within an elongate outer tube. The inner tube includes a first end for receiving the filler material and fluid carrier from the diverter subsystem and a second end for dispensing the filler material from the inner tube. The inner tube also includes openings that allow the fluid carrier to escape the inner tube. The fluid carrier is collected in the space between the inner tube and the outer tube.

In another aspect, the present invention relates to a delivery subsystem that is used to introduce the filler material into a fluid carrier. The delivery system includes a hopper for accumulating the filler material, a feed tank for selectively introducing the filler material into the fluid carrier, and an air lock between the hopper and the feed tank. The feed tank is provided with flexible rotors that meter the filler material into the fluid carrier.

The present invention also relates to a knife plate for slicing the filler material after a portion has been introduced into a measuring chamber. The knife plate includes a long outside cutting edge and a short inside cutting edge in the shape of a cleaver. The long outside cutting edge and short inside cutting edge are positioned such that the cut made by the long outside cutting edge overlaps the cut made by the short inside cutting edge.

In still another aspect, the present invention relates to a measuring chamber that includes vent bars along its inner periphery to provide indentations in the filler material as it is being dispensed into a container. These indentations remain in the filler material as it is being dispensed into the container and allow air in the container to escape as the filler material fills the container.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

While the preferred embodiment of the invention has been illustrated and described, it will be appreciated that various changes can be made therein without departing from the spirit and scope of the invention.

The present invention is an improvement to the container filling systems described in U.S. Pat. Nos. 4,961,446 and 4,893,660. The disclosures of the two above-identified U.S. patents are incorporated into the present specification by reference. The improvement relates generally to the apparatus or system that provides filler material to the measuring chambers of the systems described in the above-identified patents.

The measuring subsystem, transfer subsystem, discharge subsystem, synchronized drive subsystem, and container advance subsystem are substantially the same and operate in substantially the same manner as those same subsystems in the two above-identified patents. For purposes of full disclosure and best mode, differences between the measuring, transfer, discharge, synchronized drive and container advance subsystems of the two above-identified patents and the present invention are described below. One difference between the embodiment of the present invention described below and the embodiment described in the '446 patent for dispensing amorphous material relates to the orientation of the filler material when it is introduced into a measuring chamber. In the device of the '446 patent the filler material is randomly oriented. In contrast, the device of the present invention aligns the filler material in one direction for introduction into the measuring chambers. When whole salmon is the filler material, the filler material is introduced into the container such that when the container is opened, a clean cross-section of salmon is presented that gives the appearance of a single chunk of salmon. For ease of understanding and comparison, the numbering convention of U.S. Pat. No. 4,961,446 is adopted for the above-listed subsystems, with the addition of a ′ (prime).

Figure 3:
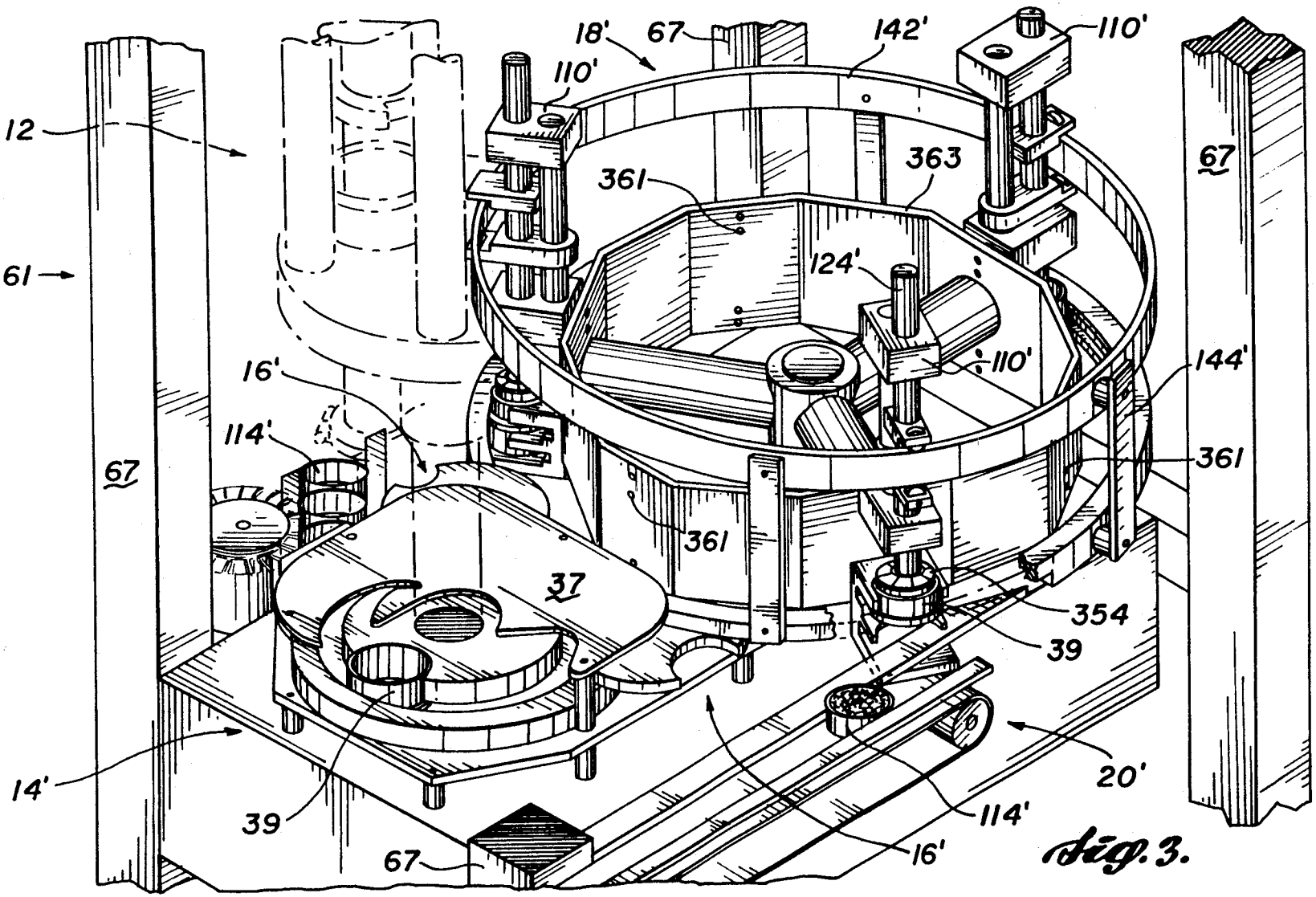
FIG. 3 is an enlarged perspective view of a portion of the container filling system of FIG. 2.

Briefly, referring to FIG. 3 of the present application, filler material is delivered to measuring subsystem 14′ from the material feed system 12 formed in accordance with the present invention. Measuring subsystem 14′, which operates in a continuous rotational pattern, produces portions of closely controlled weight and volume from the filler material supplied by material feed system 12. These measured portions are then advanced to a transfer subsystem 16′. Transfer subsystem 16′ transfers the controlled portions of filler material produced by measuring subsystem 14′ to discharge subsystem 18′. The continuously rotating discharge subsystem 18′ dispenses the precisely controlled portions of filler material into containers 114′ advanced through discharge subsystem 18′ by a container advance subsystem 20′. To ensure that the various subsystems described above operate in synchronization, a common synchronized drive subsystem is provided. For a more detailed description of each of the individual subsystems described above, reference is made to the disclosure of U.S. Pat. No. 4,961,446.

Figure 1:
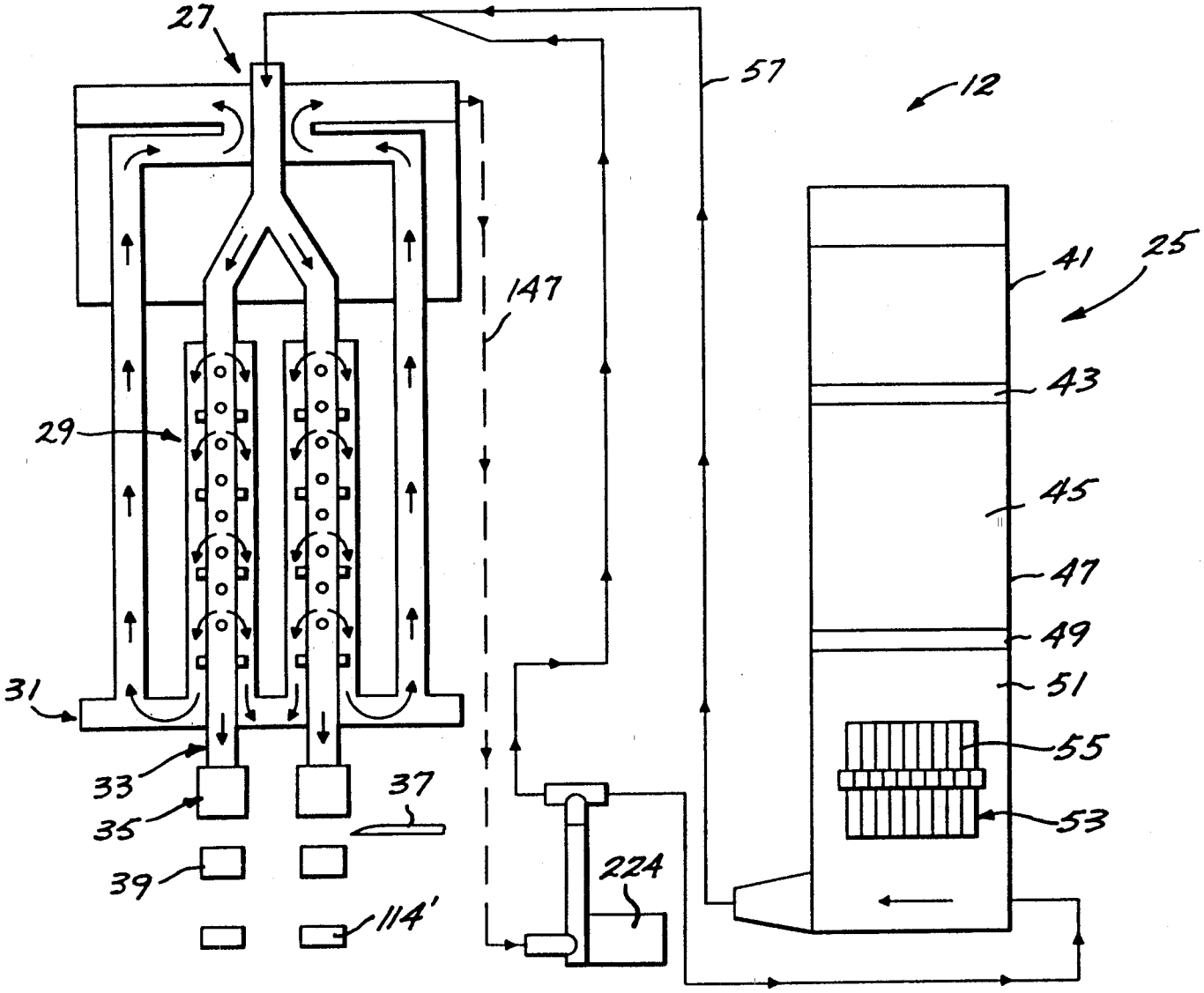
FIG. 1 is a schematic view of the container filling system formed in accordance with the present invention.
Figure 2:
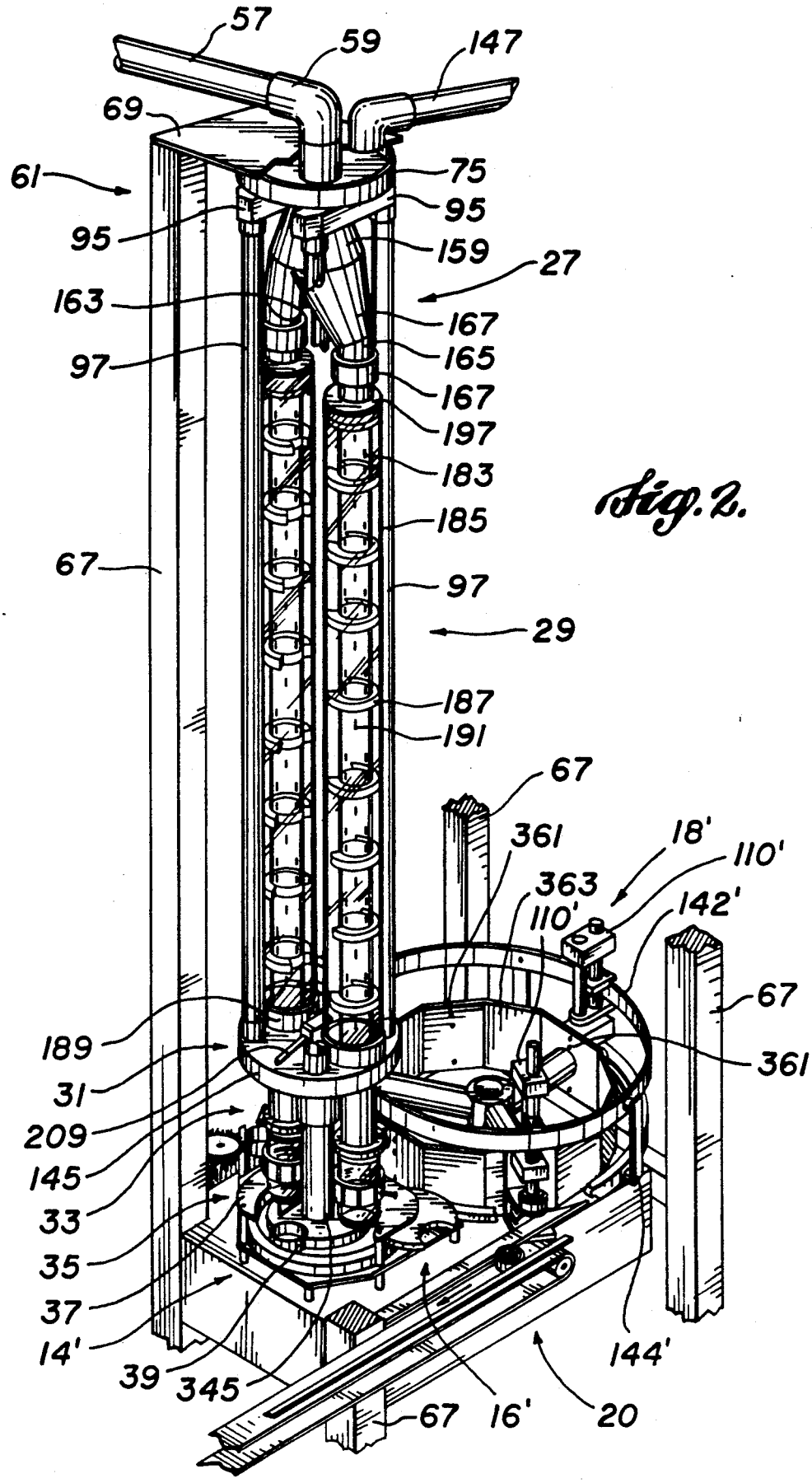
FIG. 2 is a perspective view of a container filling system formed in accordance with the present invention excluding the delivery subsystem.

Referring to FIGS. 1, 2, and 3, the improvement of the present invention relates to material feed system 12 that provides filler material in a fluid carrier to measuring subsystem 14′. Material feed system 12 includes the following subsystems that will be described in more detail below.

1. Delivery Subsystem 25

Delivery subsystem 25 meters filler material into the fluid carrier.

2. Diverter Subsystem 27

Diverter subsystem 27 divides the stream of filler material and fluid carrier coming from delivery subsystem 25 into two separate streams.

3. Concentrator Subsystem 29

Concentrator subsystem 29 concentrates filler material by separating it from the fluid carrier.

4. Fluid Carrier Collection Subsystem 31

Fluid carrier collection subsystem 31 collects the fluid carrier that is separated in the concentrator subsystem and returns it to delivery subsystem 25.

5. Taper Subsystem 33

Taper subsystem 33 compresses the filler material that is delivered to it from concentrator subsystem 29.

6. Drain Subsystem 35

Drain subsystem 35 removes remaining carrier fluid from the filler material after it has been compressed in taper subsystem 33.

7. Knife Plate 37

Knife plate 37 severs the filler material after it is dispensed into a measuring chamber 39.

The improvement of the present invention allows more containers per minute to be filled. In the systems described in the '446 and '660 patents, the speed of filling and the plug shape of the fill created problems of air pressure build up in the containers, making it difficult to introduce the filler material therein. As the plug-shaped portion of the filler material was introduced into a container, it tended to trap air in the container. Since the air could not escape the container, the built-up pressure tended to "pop" the filler material out of the container when the downward pressure on the filler material was applied. The improved measuring chamber 39 that is described in more detail below overcomes this problem.

The improvement of the present invention also relates to a new knife plate 37 for cutting the filler material after it is introduced into measuring chambers 39 and while it is still under pressure. When the filler material is whole salmon, cutting under pressure prevents dragging of skin and bones in a vertical direction over the blades of the knife which otherwise would prematurely wear out the blades. Cutting the salmon under pressure promotes a slicing and shearing in a horizontal direction which produces clean cuts and promotes long blade life. In the past, downward pressure on the filler material did not remain constant throughout the cutting step. The pressure did not remain constant because support for the filler material near the completion of the cut was lost because most of the filler material had been severed, leaving only a small connected part. The knife plate of the present invention overcomes the shortcomings of prior knives by producing two overlapping cuts made by two separate blades or edges. In accordance with the present invention, the problematic last part of the cut described above, is cut first by one edge of the knife plate of the present invention, while a large part of the filler material is uncut. This problematic last part is then redundantly cut by an overlapping long slicing action provided by the other edge of the knife plate.

To facilitate the reader's understanding of the present invention, the apparatus formed in accordance with the present invention will be described in relation to each of the individual subsystems. Thereafter, the overall operation of the system will be described.

Referring to FIG. 1, delivery subsystem 25 formed in accordance with the present invention, includes hopper 41 that is a rectangular tank having an open top and a conical bottom. The top of hopper 41 is open so that filler material may be dumped into its interior. The conical bottom of hopper 41 is provided with valve 43 that is described in more detail below. Hopper 41 also includes a sensor (not shown) to detect the level of filler material that is contained therein. Exemplary types of sensors include those that rely upon mechanical, electrical, or optical principles.

Actuation of valve 43 allows the bottom of hopper 41 to be open or closed. Valve 43 also forms part of air lock 45 below hopper 41. The balance of air lock 45 is provided by a rectangular tank 47 below valve 43 and a lower air valve 49 below tank 47.

Below lower valve 49 is feed tank 51 that is rectangular, having an open top, closed bottom, front and rear wall, and left and right sidewalls. The left sidewall and the right sidewall near the bottom of feed tank 51 include openings for allowing fluid carrier to pass through the bottom portion of feed tank 51. A rotor 53 with flexible vanes 55 is provided above the bottom of feed tank 51 and serves to meter filler material above rotor 53 into the fluid carrier in the lower part of tank 51. The fluid carrier carries the filler material through the opening in the left sidewall and into a delivery tube 57. To monitor the fluid carrier level in feed tank 51, a water level sensor (not shown) is provided. A filler material level sensor (not shown) is also provided on tank 51.

Feed tank 51 is a pressurized vessel. In order to maintain a constant pressure in feed tank 51, it must be isolated from ambient conditions during filling. Air lock 45 isolates feed tank 51 from ambient conditions in the following manner. When feed tank 51 is full of filler material, lower valve 49 is closed. In order to fill air lock tank 47 with filler material, upper air valve 43 is opened. Filler material in hopper 41 fills air lock tank 47. Upper valve 43 is then closed and the air lock tank pressurized to substantially the same pressure as feed tank 51. When feed tank 51 needs to be filled, lower air valve 49 is opened. The pressure of feed tank 51 is maintained since air lock tank 47 is also at a pressure equal to pressure feed tank 51.

Referring additionally to FIG. 2, fluid carrier and filler material delivery tube 57 is connected to diverter subsystem 27 that is described below in more detail. Delivery tube 57 is connected to a 90° elbow 59 at the top of frame 61. Elbow 59 changes the direction of flow of the filler material and fluid carrier from horizontal to vertical. The end of elbow 59 opposite the end attached to delivery tube 57 includes rigid bearing tube 63 in FIG. 5. Bearing tube 63 continues to extend downward in a vertical direction and terminates near the entry port to diverter subsystem 27 that is described below in more detail. The end of bearing tube 63 includes a deflector 65 in FIG. 5 that changes the direction of the filler material and fluid carrier as it exits bearing tube 63.

Diverter subsystem 27, concentrator subsystem 29, fluid carrier collection subsystem 31, taper subsystem 33, and drain subsystem 35 are provided in a vertical arrangement directly above measuring subsystem 14'. The overall combination of these subsystems is supported by frame 61 that includes four vertical beams 67 positioned at the four corners of an imaginary box around the combination of subsystems. The tops of beams 67 are connected by a rectangular support plate 69. Rectangular support plate 69 is stationary and serves as an upper anchor for the rotating vertical combination of subsystems.

Figure 4:
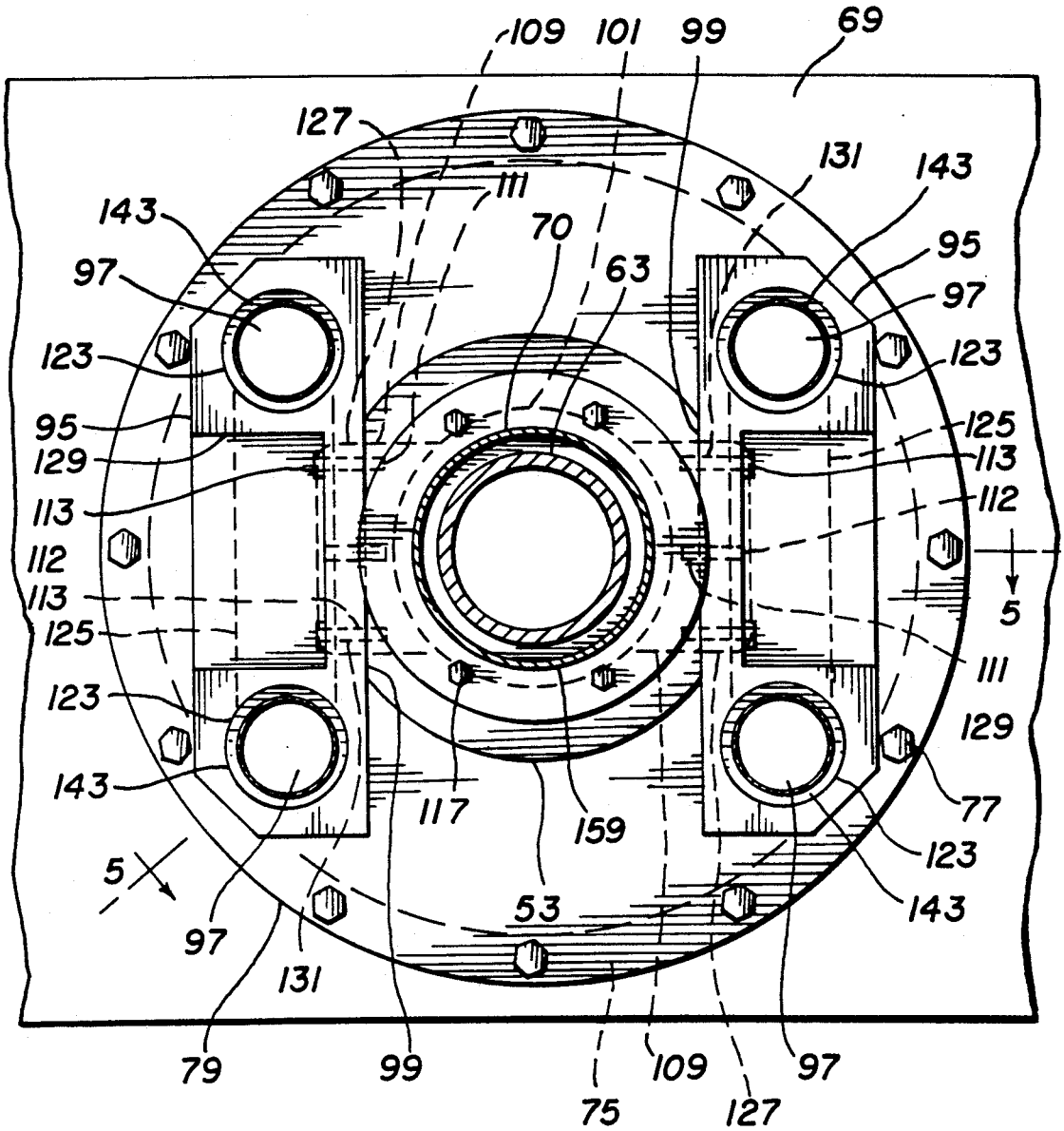
FIG. 4 is a horizontal section view of the underside of the top plate, rotor and upper manifolds of the container filling system of FIG. 2 taken along line 4—4 in FIG. 5.
Figure 5:
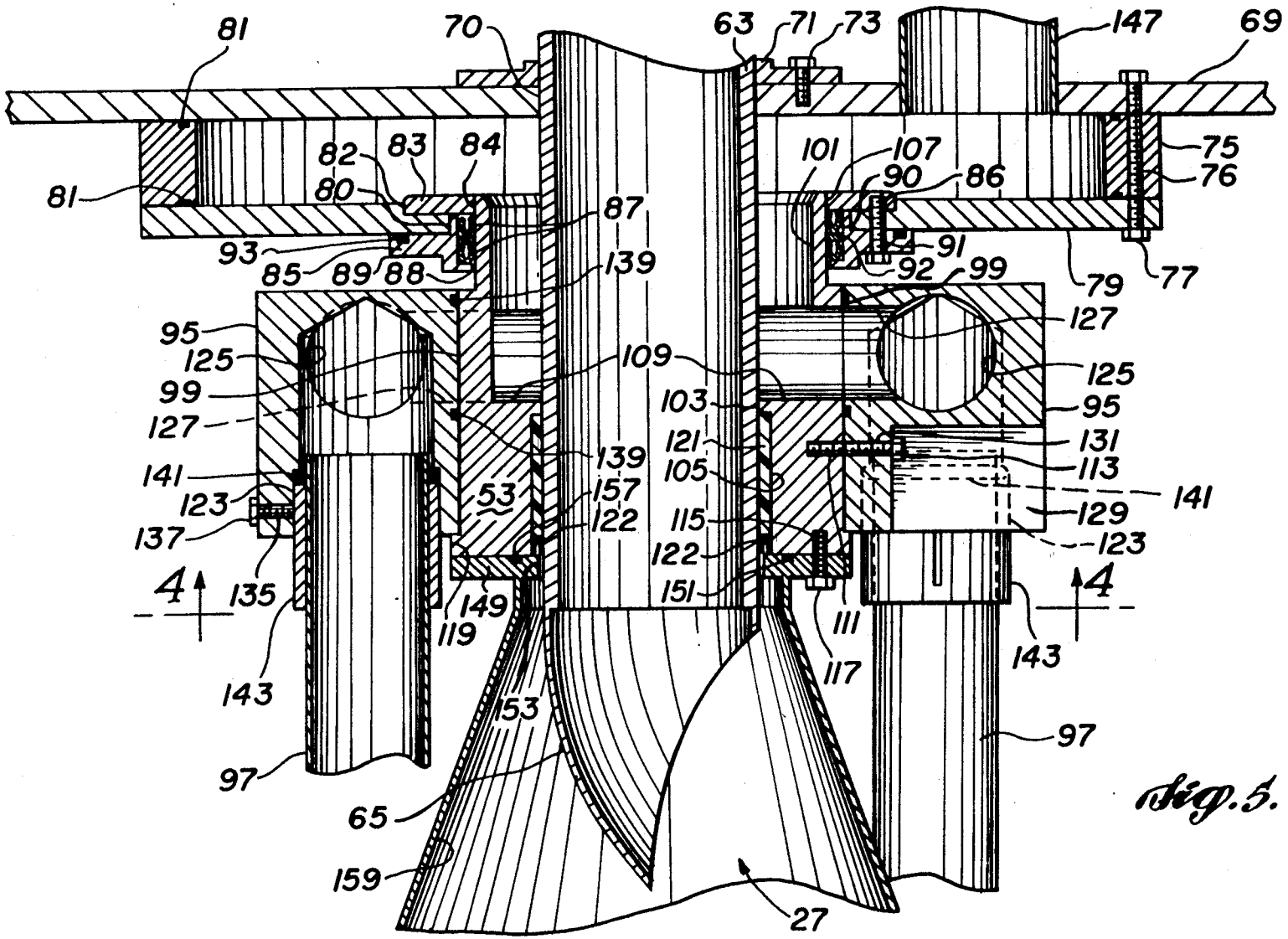
FIG. 5 is a vertical section view of the top plate, rotor and upper manifolds taken along line 5—5 in FIG. 4.
Figure 6:
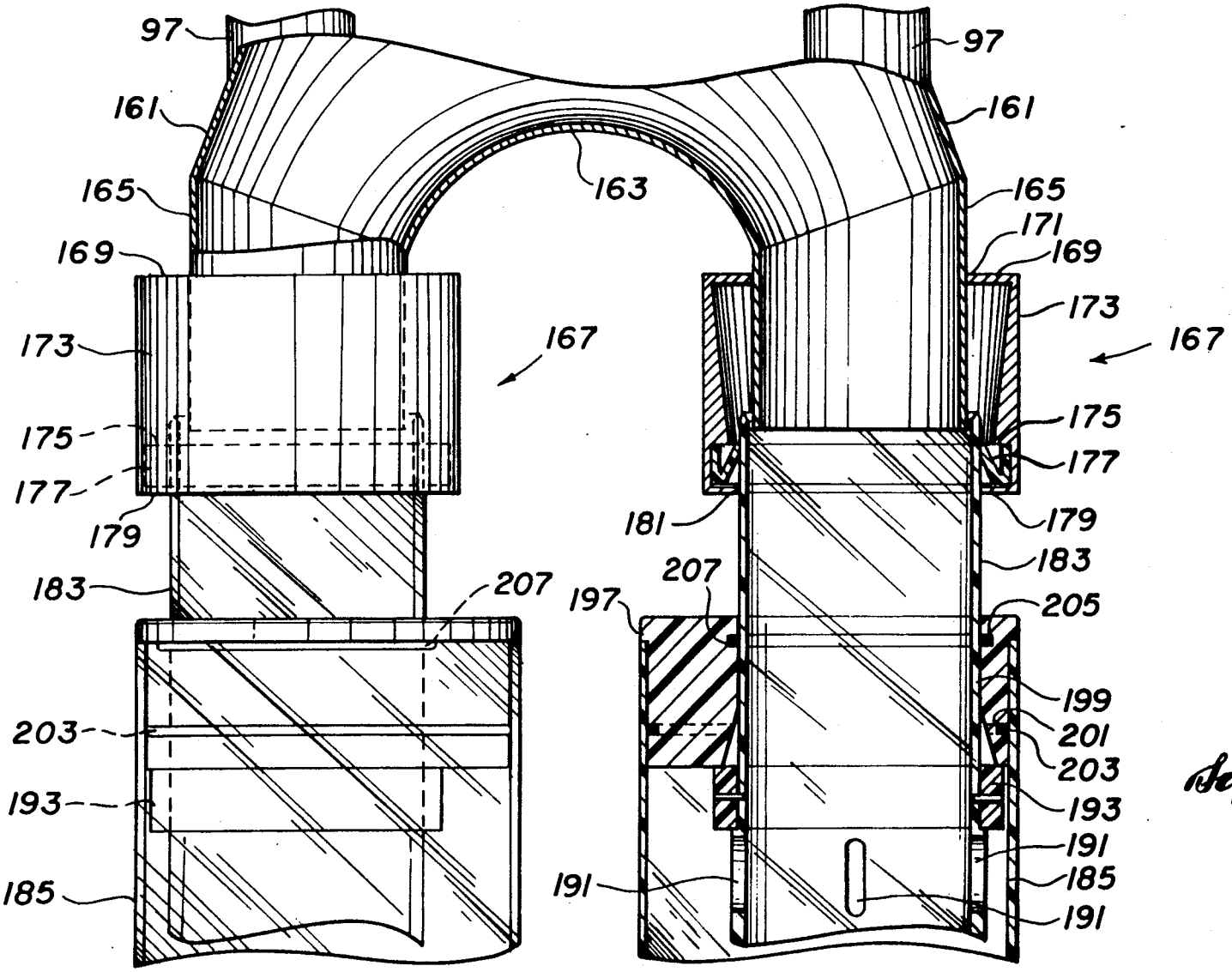
FIG. 6 is a vertical section view of a top portion of one-half and an elevation view of the other half of the concentrator subsystem and the diverter subsystem for the container filling system of FIG. 2.

Referring additionally to FIGS. 4 and 5, located at the center of support plate 69 is a bore 70 through which bearing tube 63 passes. FIG. 5 is a section view taken along line 5—5 in FIG. 4. Line 5—5 passes through the bore 70 and forms a 140° angle with its apex at the center of bore 70. As described above, bearing tube 63 is an elongate hollow cylinder that guides filler material and fluid carrier from the end of delivery tube 57 into diverter subsystem 27. Bearing tube 63 is secured to support plate 69 by bearing tube flange 71 and bolts 73. In the illustrated embodiment, support plate 69 is approximately two feet wide and three feet long and bearing tube 63 has an outer diameter of about 3.5 inches.

Secured to the underside of the support plate 69 is top ring 75. Top ring 75 is an annulus that in the illustrated embodiment has a height of about 1.5 inches, an inner diameter of about 15 inches, and an outer diameter of about 16.5 inches. Top ring 75 is positioned concentrically with respect to bore 70. Top ring 75 also includes a plurality of equally spaced bolt holes 76 that receive bolts 77 that are threaded into support plate 69 to secure top ring 75 thereto. The upper surface of top ring 75 abuts the underside of support plate 69 and the bottom surface abuts top disc 79 that is described in more detail below. The upper surface and lower surface of top ring 75 each include a narrow continuous groove for receiving seals 81. The grooves are located to the interior of bolt holes 76. Seals 81 seal top ring 75 to support plate 69 and top disc 79.

Top disc 79 is secured to the underside of top ring 75 and forms a chamber between the underside of support plate 69 and the top side of top disc 79. Top disc 79 in the illustrated embodiment is a round plate that includes a bore 80 passing through its center. In the illustrated embodiment, the bore is approximately 6.5 inches in diameter which provides room for bearing tube 63 to pass through top disc 79. Machined into the top of top disc 79, centered on bore 80, is a circular depression 82 having a diameter greater than the diameter of bore 80. In the illustrated embodiment, depression 82 has a diameter of approximately 8 inches. Depression 82 extends into top disc 79 approximately one-quarter of the height of top disc 79. Depression 82 creates a shoulder upon which rests a locating ring 83 described below in more detail. Top disc 79 includes two circles of bolt holes. One circle is located near the periphery of top disc 79 and matches up with bolt holes 76 in top ring 75 and support plate 69. The second circle is located on the shoulder between the periphery of depression 82 and the periphery of bore 80. Bolts 77 are passed through top disc 79, top ring 75, and support plate 69 to secure the three elements together.

Locating ring 83 is machined out of a plastic material, such as Delrin TM. A bore 84 is centered in the middle of locating ring 83. The diameter of bore 84 is greater than the diameter of bearing tube 63 which passes through bore 84 when locating ring 83 is secured to top disc 79. The diameter of bore 84 is such that rotor 53, which is described below, fits snugly into bore 84. The bottom of locating ring 83 includes six tapped holes 86 centered on a circle that matches the smaller circle of bolt holes in top disc 79. Locating ring 83 has an outer diameter that is slightly less than the diameter of circular depression 82. As discussed above, when assembled, locating ring 83 is seated in circular depression 82.

Secured to the underside of top disc 79 and centered within bore 80 is seal holder 85. Seal holder 85 positions two seals 87 against rotor subassembly 53 that is described below in more detail. Seal holder 85 includes a central bore 88 that passes completely through its body. A circular depression 90 having a diameter slightly larger than the diameter of bore 88 is centered on the middle of bore 88. Depression 90 extends slightly more than half-way through seal holder 85. The shoulder that is created at the bottom of depression 90 has an inner diameter equal to the outer diameter of rotor subassembly 53. The outer diameter of bushing 92 is substantially equal to the diameter of circular depression 90. Bushing 92 acts as a separator for seals 87 and a locating ring to position seal holder 85 around rotor subassembly 53. Extending radially from seal holder 85 just below its midpoint is a flange 89 that includes a set of bolt holes 91. Bolt holes 91 are equally spaced on a bolt circle having the same diameter as the smaller circle of bolt holes on top disc 79 and the circle of tapped holes 86 in locating ring 83. Located in the upper surface of flange 89, outside of the circle of bolt holes 91, is a channel for receiving a seal 93.

Referring to FIGS. 4 and 5, upper manifolds 95, tops of return fluid carrier tubes 97, and diverter subsystem 27 are mounted on a rotor 53 that rotates freely about stationary bearing tube 63. Rotor 53 is not secured to top disc 79, but rather rotates within bore 84 through locating ring 83 and bore 88 through seal holder 85. Rotor 53 is supported within top disc 79 by return fluid carrier tubes 97 and diverter subsystem 27.

Rotor 53 can be generally described as a cylinder with opposing sides sheared away to provide parallel flat mounting surfaces 99. In the illustrated embodiment, the body of rotor 53 has an outer diameter of approximately eight inches and a height of approximately six inches. The spacing between the parallel mounting surfaces 99 is approximately 6½ inches. The center of rotor 53 includes three bores having different diameters. Top bore 101 extends from the top of rotor 53 down to about the midpoint of rotor 53. In the illustrated embodiment, top bore 101 has a diameter of approximately 5¼ inches. From the bottom of top bore 101 extends middle bore 103 which, in the illustrated embodiment, has a diameter of approximately 3½ inches. The length of middle bore 103 is small, approximately 3/16ths of an inch in the illustrated embodiment. From the bottom of middle bore 103 extends bottom bore 105. Bottom bore 105 extends to the bottom of rotor 53. In the illustrated embodiment, bottom bore 105 has a diameter of about four inches.

The top ¼ of rotor 53 includes an annulus defined between top bore 101 and the outer surface 107 of rotor 53. Outer surface 107 of the annulus has a diameter slightly less than the diameter of bore 84 in locating ring 83 and bore 88 through seal holder 87. Accordingly, this annular portion of rotor 53 fits within these bores. The height of the annular portion is such that top of rotor 53 is flush with the top of locating ring 83 and the bottom of the annular portion is located below the bottom of seal holder 87. In the illustrated embodiment, the annular ring is approximately 1½ inches high. Rotor 53 also includes two flat, rectangular bores 109 that extend from flat surfaces 99, through rotor 53, to bore 101. The bottom of rectangular bores 109 coincides with the bottom of top bore 101. In the illustrated embodiment, rectangular bores 109 are about four inches wide and 1½ inches high. As described in more detail below, the combination of rectangular bores 109 and top bore 101 provides a passageway for return fluid carrier through rotor 53. Centered between the bottom of each rectangular bore 109 and the bottom of the rotor 53 are two tapped holes 111 and dowel pin 112 arranged in a horizontal plane. Tapped holes 111 receive threaded ends of bolts 113 that pass through upper manifolds 95 and secure them to rotor 53. Machined into the underside of rotor 53 in a bolt circle having a diameter larger than the diameter of bottom bore 105 are six equally spaced tapped holes 115. As described below in more detail, tapped holes 115 receive bolts 117 that secure diverter subsystem 27 to rotor 53. The bottom of rotor 53 also includes a short shoulder 119 that extends radially outward. As described in more detail below, shoulder 119 serves as a stop for upper manifolds 95.

Bearing tube 63 passes through the top 101, middle 103, and bottom 105 bores in rotor 53. The outer diameter of bearing tube 63 is slightly less than the diameter of middle bore 103. The space between the surface of bottom bore 105 and the outer diameter of bearing tube 63 carries a Delrin TM bushing 121 which reduces friction at the surface of spinning rotor 53. Below Delrin TM bushing 121 is seal 122 that seals rotor 53 to the outside of bearing tube 63.

Referring to FIGS. 2, 4, and 5, secured to each of the two flat surfaces 99 of rotor 53 is an upper manifold 95. Each manifold 95 is a generally rectangular block which in the illustrated embodiment is about four inches high, three inches wide and about eleven inches long. Each manifold 95 includes passages for delivering return fluid carrier from return tubes 97 to rotor 53. These passages include two round holes 123 machined into the bottom of each manifold 95. One hole 123 is centered near the left edge and the other hole 123 is centered near the right edge of manifold 95. Holes 123 are machined with dimensions that allow them to receive the top of fluid carrier return tubes 97. In the illustrated embodiment, holes 123 are machined into the manifolds to a depth approximately three-quarters of an inch below the top of manifold 95. The top of one hole 123 in one manifold 95 is connected to the top of the other hole 123 in the same manifold by a horizontal bore 127. Horizontal bore 125 is located closer to the top of manifold 95 than are the tops of holes 123 and in the illustrated embodiment is approximately one-quarter of an inch below the top. In the illustrated embodiment, horizontal bore 125 has a diameter of approximately one and seven-eighths inch. The middle section of horizontal bore 125 also communicates with a rectangular-shaped bore 127 that is perpendicular to horizontal bore 125. Perpendicular bore 127 passes through the side of manifold 95 that is attached to rotor 53 as described below in more detail. The combination of holes 123, horizontal bore 125, and rectangular bore 127 provide a pathway through manifold 95 for the fluid carrier.

Manifold 95 at its bottom, opposite the side that rectangular bore 127 passes, includes a rectangular cut-out section 129 between holes 123. The height of rectangular cut-out section 129 is such that it does not intrude upon horizontal bore 125 or rectangular bore 127. The inside wall of rectangular cutout section 129 includes two bolt holes 131 and dowel pin 112 that pass perpendicularly through to the opposite side of manifold 95. Bolt holes 131 line up with tapped holes 111 in the flat surface 99 of rotor 53. Bolts 113 pass through bolt holes 131 into tapped holes 111 and secure manifold 95 to rotor 53. The ends and the outer side of each manifold 95 include tapped holes 135 for receiving bolts 137 that secure the top of return fluid carrier tubes 97 in manifold 95. The surface of manifold 95 that abuts flat surface 99 includes a groove located around rectangular bore 109 for receiving a seal 139. Seal 139 seals manifold 95 to rotor 53.

The tops of vertical holes 123 include a groove that receives an O-ring 141 that seals tubes 97 to manifold 95. The diameter of holes 123 is larger than the outer diameter of return fluid carrier tubes 97. The larger diameter of holes 123 permits them to receive a compression sleeve 143 that fits over the top of return fluid carrier tubes 97. Compression sleeve 143 is a ring with vertical slots passing through the sidewall at equally spaced intervals. When compression sleeve 143 is placed around the top of fluid carrier tubes 97 and the assembly is inserted into holes 123, bolts 137 are threaded into tapped holes 135 to compress sleeve 143 around tube 97 and hold both in place within manifold 95.

Figure 7:
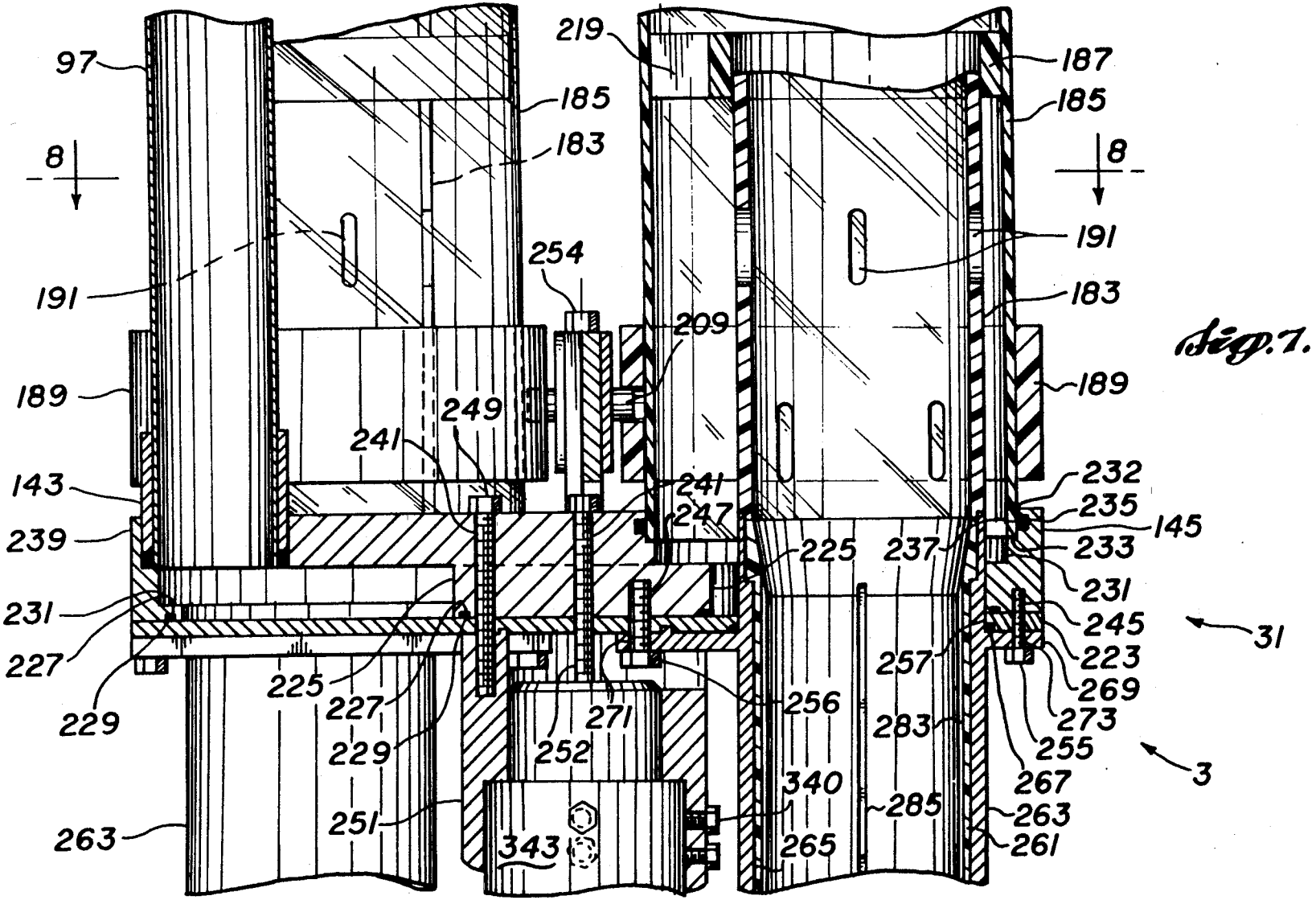
FIG. 7 is a vertical section view of the bottom of the concentrator subsystem, top of the taper subsystem and the lower manifold taken along line 7—7 in FIG. 8.

Referring to FIGS. 2, 4, and 5, return fluid carrier tubes 97 are hollow cylinders that extend from upper manifolds 95 to lower manifold 145 in FIG. 7. As described above, each upper manifold 95 receives two return fluid carrier tubes 97. The four tubes 97 are positioned at the corners of a square. Return fluid carrier tubes 97 transport fluid carrier from lower manifold 145, which is described below in more detail, to the upper manifolds 95 where the fluid carrier is delivered to rotor 53 and back into a return fluid carrier line 147. In the illustrated embodiment, the tubes are approximately 2 inches in diameter.

Referring to FIGS. 2, 5, 6, 11, and 12, diverter subsystem 27 divides the stream of fluid carrier and filler material in delivery tube 57 into two separate streams that flow into concentrator subsystem 29 that is described below in more detail. Diverter subsystem 27 has the general shape of an inverted "Y". The top of diverter subsystem 27 includes a flange 149 that has bolt holes 151 that align with tapped holes 115 provided on the underside of rotor 53. Flange 149 includes a bore 153 that passes through the middle thereof having a diameter slightly greater than the outer diameter of bearing tube 63. A concentric channel 155 having a diameter greater than the diameter of bore 153 is provided in the top of the flange for receiving a seal 157 that seals flange 149 to the underside of rotor 53. The portion of diverter subsystem 27 below flange 149 is shaped like a truncated cone. The narrower portion of the truncated cone 159 is attached to the bottom of flange 149 and the larger end of the cone is attached to a transition section 161. Transition section 161 on its left and right outer periphery continues the expanding diameter of truncated cone section 159. The bottom or underside of transition section 161 includes a curved elbow 163 that divides transition section 161 into two separate flow paths that are directed into concentrator subsystem 29. The front surface and rear surface of diverter subsystem 27 below cone section 159 are sloped inward toward the center of diverter subsystem 27 so that the flow of fluid carrier and filler material is directed into concentrator subsystem 29. Elbow 163 includes a lower left end and a lower right end. Transition section 161 also includes a lower right end and a lower left end. The two right ends and the two left ends are connected to the top of separate tubes 165. Tubes 165 are circular cylinders having an outer diameter that allows each tube to mate with concentrator subsystem 29 described below. Each tube 165 is provided with a housing 167 that encloses the connection between tubes 165 and concentrator subsystem 29.

Housing 167 includes an upper circular disc 169 that includes a bore 171 for allowing tube 165 to pass therethrough. Extending down from the underside of disc 169 is an annulus 173 having an inner diameter greater than the outer diameter of tube 165. The inner diameter of annulus 173 decreases from top to bottom, creating a beveled surface. The inner surface of the bottom of annulus 173 has a radially extending groove 175 for receiving a seal 177 that seals annulus 173 to concentrator subsystem 29. The bottom of annulus 173 is attached to another disc 179 that has a bore 181 passing through the middle of it having a diameter substantially equal to the outer diameter of inner tube 183 of concentrator subsystem 29. Inner tube 183 passes through lower disc 179 and is mated with the bottom of tube 165 of diverter subsystem 27. Seal 177 seals the outer surface of inner tube 183 to housing 167.

Referring additionally to FIGS. 2, 6, 7, 13, and 14, concentrator subsystem 29 formed in accordance with the present invention includes two vertical concentrators that each include an inner tube 183, outer tube 185, flow control rings 187, and lift ring 189. Concentrator subsystem 29 removes fluid carrier and concentrates and pressurizes the filler material into the shape of a cylinder. Inner tube 183 of concentrator subsystem 29 is an elongate tube, preferably made from a translucent or transparent plastic. In the illustrated embodiment, inner tube 183 is approximately 78½ inches long having an inner diameter of approximately 3½ inches and outer diameter of approximately 4 inches. Inner tube 183 includes 18 rows of slots 191, each row including four slots positioned 90° from each other around inner tube 183. Slots 191 in one row are offset 45° from slots 191 in the previous row. The rows of slots 191 in the illustrated embodiment are spaced apart approximately 4⅛th inches. Slots 191 are in the shape of an oval with the long axis being parallel to the longitudinal axis of inner tube 183. The centerpoints of the semicircular ends of slots 191 are about one inch apart in the illustrated embodiment. The semicircular ends of slots 191 have a radius of approximately ⅛th of an inch.

The outer surface of the top of inner tube 183 has an outer diameter that is slightly less than the outer diameter of the major length of inner tube 183. The bottom of this narrowed portion of inner tube 183 provides a shoulder that carries stop ring 193 described below. In the illustrated embodiment, this portion of inner tube 183 is about 6.5 inches long and has an outer diameter of about 3⅞ inch. The outer diameter of the bottom of inner tube 183 is also less than the outer diameter of the major length of tube 183. In the illustrated embodiment, the outer diameter at the bottom of inner tube 183 is approximately 3.75 inches. This narrowed portion of inner tube 183 extends up along the length of inner tube 183 approximately an eighth of an inch. The dimensions of the bottom of inner tube 183 allow it to mate with taper subsystem 33 that is described below in more detail. Above this narrowed portion of the bottom of inner tube 183 a channel (not shown) can be machined into the outer surface of inner tube 183 to provide a means for engaging a tool to pry up inner tube 183 for removal.

Outer tube 185 of concentrator subsystem 29 is another elongate tube, preferably made from a clear or translucent plastic material. Outer tube 185 has an inner diameter that is greater than the outer diameter of inner tube 183. In the illustrated embodiment, outer tube 185 has an inner diameter of approximately 5¾ inches. The outer diameter of outer tube 185 is approximately 6 inches in the illustrated embodiment. The top of outer tube 185 includes a shoulder 197 that seals outer tube 185 to inner tube 183. Shoulder 197 is a cylinder that fits snugly within the top of outer tube 185. Shoulder 197 is also provided with a bore 199 for receiving and allowing inner tube 183 to pass through it. The outer surface of shoulder 197 near the bottom includes a circumferential groove 201 that receives seal 203 that seals shoulder 197 to the inside of outer 185. The top of shoulder 197 includes a radially extending flange that acts as a stop for outer tube 185 as it is slid around shoulder 197.

Bore 199 for receiving inner tube 185 is located off center from the center of shoulder 197 so that when inner tube 183 is passed through shoulder 197, it is eccentric in relation to outer tube 185. In the illustrated embodiment, bore 199 for inner tube 183 is approximately ½ inch off center. In the illustrated embodiment, bore 199 has a diameter of approximately 4 inches as it passes from the top of shoulder 197 to a point approximately three-quarters through shoulder 197. The lower one-quarter of bore 199 is beveled outward so that the bottom of bore 199 is approximately 4⅜ths inches in diameter. The bevel is provided so that inner tube 183 can be easily guided into and through shoulder 197. The inner surface of shoulder 197, near the top, includes a seal channel 205 for seal 207 that seals shoulder 197 to the outside surface of inner tube 183.

Approximately two inches from the bottom of outer tube 185 in the illustrated embodiment, is located a lift ring 189. Lift ring 189 receives a lift handle 209 for lifting outer tube 185 enough so that it may be removed for cleaning. Lift ring 189 is an annulus that has an inner diameter that allows it to fit snugly on the outside of outer tube 185. In the illustrated embodiment, lift ring 189 is approximately 2½ inches high. On one side, a horizontal channel is machined into the middle of lift ring 189, providing a gap that will receive a portion of lift handle 209 that is described below. Lift ring 189 is secured to outer tube 185 using pins.

When assembled, inner tube 183 extends above shoulder 197. The top of inner tube 183 is received into housing 167 of diverter subassembly 27. As mentioned above, inner tube 183 near its top is provided with a stop ring 193 that limits the extent that inner tube 183 can be extended through shoulder 197. Stop ring 193 is an annulus that has a bore 213 with a diameter approximately the same as the outer diameter of the upper portion of inner tube 183. Stop ring 193 fits snugly around inner tube 183 and is secured to inner tube 183 by pins. As inner tube 183 is slid through shoulder 197, stop ring 193 abuts the bottom of shoulder 197, which prevents any additional movement of inner tube 183 through shoulder 197.

Located around inner tube 183 between every two sets of slots 191 is a flow control ring 187. Each flow control ring 187 is used to determine the amount of filler material that has filled inner tube 183 as described below in more detail. Flow control rings 187 include a central bore 217 that has a diameter substantially equal to the outer diameter of inner tube 183. The outer periphery of flow control rings 187 is not round, but rather is in the shape of the space between the outer surface of inner tube 183 and the inner surface of outer tube 185. An angular section centered around the widest portion of flow control rings 187 in a radial direction is removed to provide a gap 219 through which fluid carrier can flow. Flow control ring 187 opposite gap 219 is provided with an expansion joint that allows flow control ring 187 to be positioned on inner tube 183 and then firmly secured using a compression screw 221. Each flow control ring 187 includes a gap 219 that has a different cross-sectional area than the other flow control rings 187. In the illustrated embodiment, inner tube 183 includes eight flow control rings 187. The bottom flow control ring 187 includes a gap that occupies 50° of the circumference of flow control ring 187. Moving up inner tube 183, respective flow control rings 187 include gaps that occupy 100°, 90°, 80°, 70°, 60°, 50°, and 40° of the circumference of the respective flow control ring 187. When flow control rings 187 are positioned around inner tube 183, concentrator subsystem 29 is divided up into individual chambers between adjacent flow control rings 187. The method of determining the amount of filler material in inner tube 183 will be described below in more detail.

When a stream of fluid carrier and filler material from diverter subsystem 27 flows into inner tube 183 of concentrator subsystem 29, the fluid carrier escapes inner tube 183 by flowing through slots 191. Slots 191 are dimensioned so that the filler material does not escape inner tube 183. As the fluid carrier escapes inner tube 183, it gravitates down through gaps 219 in flow control rings 187 to the bottom of the space between inner tube 183 and outer tube 185. At the bottom, the fluid carrier is collected in lower manifold 145 that is described below in more detail. The filler material is further compressed and drained of remaining fluid carrier in the taper 33 and drain 35 subsystems as described below in more detail.

Figure 8:
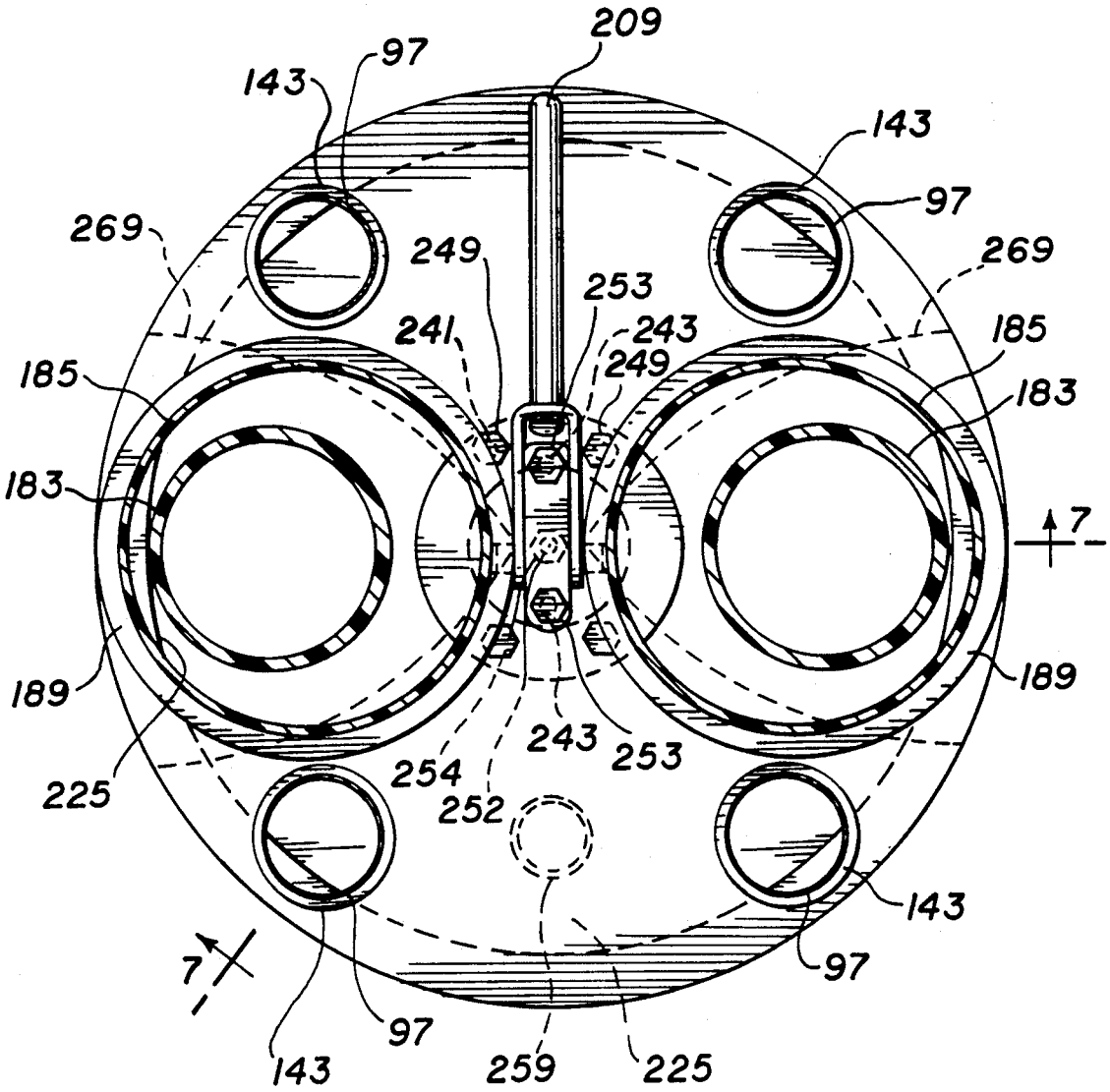
FIG. 8 is a horizontal section view take along line 8—8 in FIG. 7.

Referring to FIGS. 7 and 8, the system formed in accordance with the present invention includes a fluid carrier collection subsystem 31. FIG. 7 is a section view taken along line 7—7 in FIG. 8. Line 7—7 passes through the center of fluid carrier collection subsystem 31 and forms a 130° angle with its apex at the center of subsystem 31. Fluid carrier collection subsystem 31 includes lower manifold 145 and a lower cover plate 223 that form a chamber for collecting the fluid carrier that has separated from the filler material in concentrator subsystem 29. Fluid carrier collection subsystem 31 collects the fluid carrier and returns it to delivery subsystem 25 through the fluid carrier return tubes 97, upper manifolds 95, rotor 53, and fluid carrier return line 147. Fluid carrier return line 147 passes through bypass valve 224 which is controlled to direct the fluid carrier to feed tank 51 or back into delivery tube 57 as make-up fluid carrier.

Lower manifold 145 as described above collects the separated fluid carrier. It also supports inner tubes 183 and outer tubes 185 and also receives one end of each of four fluid carrier return tubes 97. In the illustrated embodiment, lower manifold 145 is a circular disc with a circular channel 225 in its underside. Circular channel 225 extends up into lower manifold 145 approximately one-half of its height. Circular channel 225 begins just inside the outer periphery of lower manifold 145 and extends towards the center of lower manifold 145. In the illustrated embodiment, circular channel 225 is about 4.5 inches wide which leaves a hub in the center of lower manifold 145 about 4 inches in diameter. In the illustrated embodiment, lower manifold 145 is approximately 1¾ inch high. Located around the outer periphery and inner periphery of circular channel 225 are two seal seats 227 for receiving seals 229 that seal lower manifold 145 to lower cover plate 223 that is described below in more detail. The top of lower manifold 145 includes two bores 231 that extend down to circular channel 225. Bores 231 have an upper section 232 that has a diameter substantially equal to the outer diameter of outer tube 185 of concentrator subsystem 29. The lower half of bores 231 has a slightly smaller diameter. Accordingly, at the point where the smaller diameter begins, a shoulder 233 is formed upon which outer tube 185 rests when it is seated in lower manifold 145. The sidewall of upper section 232 of bore 231 includes a seal channel 235 that extends completely around the periphery of bore 231. A seal 237 placed in seal channel 235 seals the outer surface of outer tube 185 to lower manifold 145. Bores 231 are located 180° from each other. Since bores 231 for concentrator subsystem 29 open into circular channel 225, a continuous opening is provided through lower manifold 145 for taper subsystem 33 described below in more detail.

The top of lower manifold 145 also includes four holes 239 that extend down to channel 225. Four holes 239 are dimensioned so that they will receive compression sleeves 143 for return fluid carrier tubes 97 in a manner similar to that described above with respect to upper manifolds 95. The center of these four holes 239 form the corners of a square and are located near the periphery of lower manifold 145. The central hub of lower manifold 145 that is not occupied by bores 231 for concentrator subsystem 29 and that is not occupied by circular channel 225 includes five bolt holes 241 that pass completely through lower manifold 145. Four of holes 241 are located around the periphery of the central hub that extends completely through lower manifold 145. The other bolt hole 241 is centered at the middle of lower manifold and also passes completely therethrough. On each side of central bolt hole 241 is a tapped hole 243 that extends down partially through lower manifold 145. The underside of lower manifold 145 around its periphery includes a circle of equally spaced tapped holes 245. Also, on the underside of lower manifold 145 are tapped holes 247 on each side of the central bolt hole 241. Tapped holes 247 are positioned 90° offset from holes 243 that are tapped in the top of lower manifold 145. Four bolt holes 241 located near the periphery of the central hub receive bolts 249 that secure hub 251 to lower manifold 145. Central bolt hole 241 receives adjustment bolt 252 that provides vertical adjustment of drain subsystem 35 and is locked in place with jam nut 254. Two tapped holes 243 receive bolts 253 that secure lift handle 209 to lower manifold 145. Finally, tapped holes 245 receive bolts 255 that secure lower cover plate 223 and flange 269 to lower manifold 145. The two holes 247 that are tapped into the bottom of lower manifold 145 receive bolts 256 to secure flange 269.

Lower cover plate 223 is circular having an outer diameter substantially equal to the outer diameter of lower manifold 145. Lower cover plate 223 serves to close off circular channel 225 in the bottom of lower manifold 145. As described above, cover plate 223 is attached to lower manifold 145 by bolts 255. Lower cover plate 223 includes two bores 257 offset 180° from each other. Bores 257 line up with bores 231 through lower manifold 145. Lower cover plate 223 also includes bolt holes that line up with bolt holes 241, 245, and 247 in lower manifold 145 for securing flange 269 as well as hub 251. Lower cover plate 223 also includes bore 259 that serves as a drain for the lower manifold 145.

Figure 9:
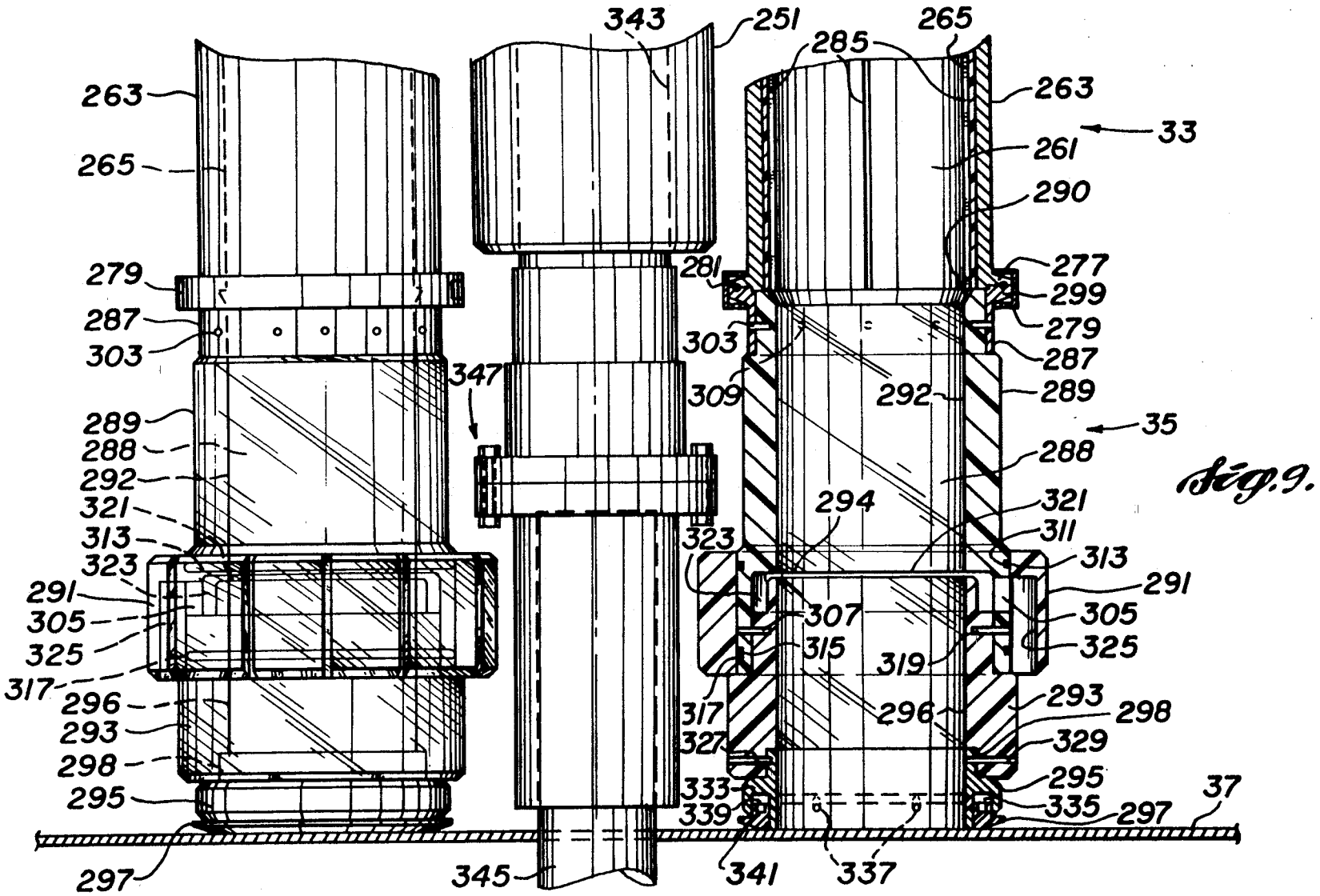
FIG. 9 is a vertical section view of one-half and a vertical plan view of the other half of the lower portion of the taper subsystem and the drain subsystem.

Referring to FIGS. 7, 8, and 9, taper subsystem 33 formed in accordance with the present invention serves as an extension of inner tube 183 of concentrator subsystem 29. Taper subsystem 33 extends through lower manifold 145 and lower cover plate 223 and carries filler material therethrough. Taper subsystem 33 is secured to the underside of lower cover plate 223. A Teflon TM taper liner 261 is provided within taper subsystem 33 to further compress the filler material.

Taper subsystem 33 includes a pair of taper mounts 263 which are vertical metal cylinders that include a central bore 265 having a diameter substantially equal to the inner diameter of inner tube 183. In the illustrated embodiment, taper mount 263 is approximately 9 inches high. The upper 1/10th of bore 265 has a diameter that is slightly larger than the inner diameter of inner tube 183. In the illustrated embodiment, the upper portion of bore 265 has a diameter of approximately 3¾ inch. The outer diameter of taper mount 263 is such that it fits snugly in bore 257 of lower cover plate 223. Seals 267 are located around bores 257 to seal taper mounts 263 to lower cover plate 223.

About one quarter of the way down taper mount 263 is an outward extending flange 269 with a triangular-shaped periphery. The cylinder which forms the majority of taper mount 263 is centrally located in triangular flange 269. Triangular flange 269 includes bolt holes 271 at each of the three corners. An additional bolt hole 273 is provided between two of the corners. Bolt holes 271 receive bolts 255 and 256 that secure taper mount 263 to the underside of lower cover plate 223. The bottom of taper mount 263 includes a radially extending flange 277 with a beveled top. Flange 277 receives a clamp 279 that secures taper mount 263 to drain subsystem 35 that is described below in more detail.

As described above, taper subsystem 33 includes a taper liner 261 positioned within taper mount 263. The outer dimensions of taper liner 261 are such that it fits snugly within taper mount 263. A preferred material for making taper liner 261 is Teflon TM, which helps reduce friction on the filler material as it passes through taper subsystem 33. A bore 283 that has a diameter slightly less than the inner diameter of inner tube 183 passes through the length of taper liner 261. Since taper liner 261 extends completely through taper mount 263, in the illustrated embodiment, its height is approximately nine inches. About one fourth of the top of the bore 283 in taper liner 261 is beveled so that the diameter of bore 283 decreases linearly from the top of taper liner 261. This beveled portion further compresses the filler material that is delivered to taper liner 261 from inner tube 183. The balance of taper liner 261 has a constant diameter. The lower ⅓ of the beveled portion and the constant diameter portion of taper liner 261 are provided with six shallow longitudinal grooves 285. Grooves 285 are spaced equally at 60° intervals around the periphery of taper liner 261. Grooves 285 allow the fluid carrier that remains in taper liner 261 to help lubricate the flow of filler material therethrough. Fluid carrier that flows through taper mount 263 is removed in drain subsystem 35 that is described below in more detail.

Figure 10:
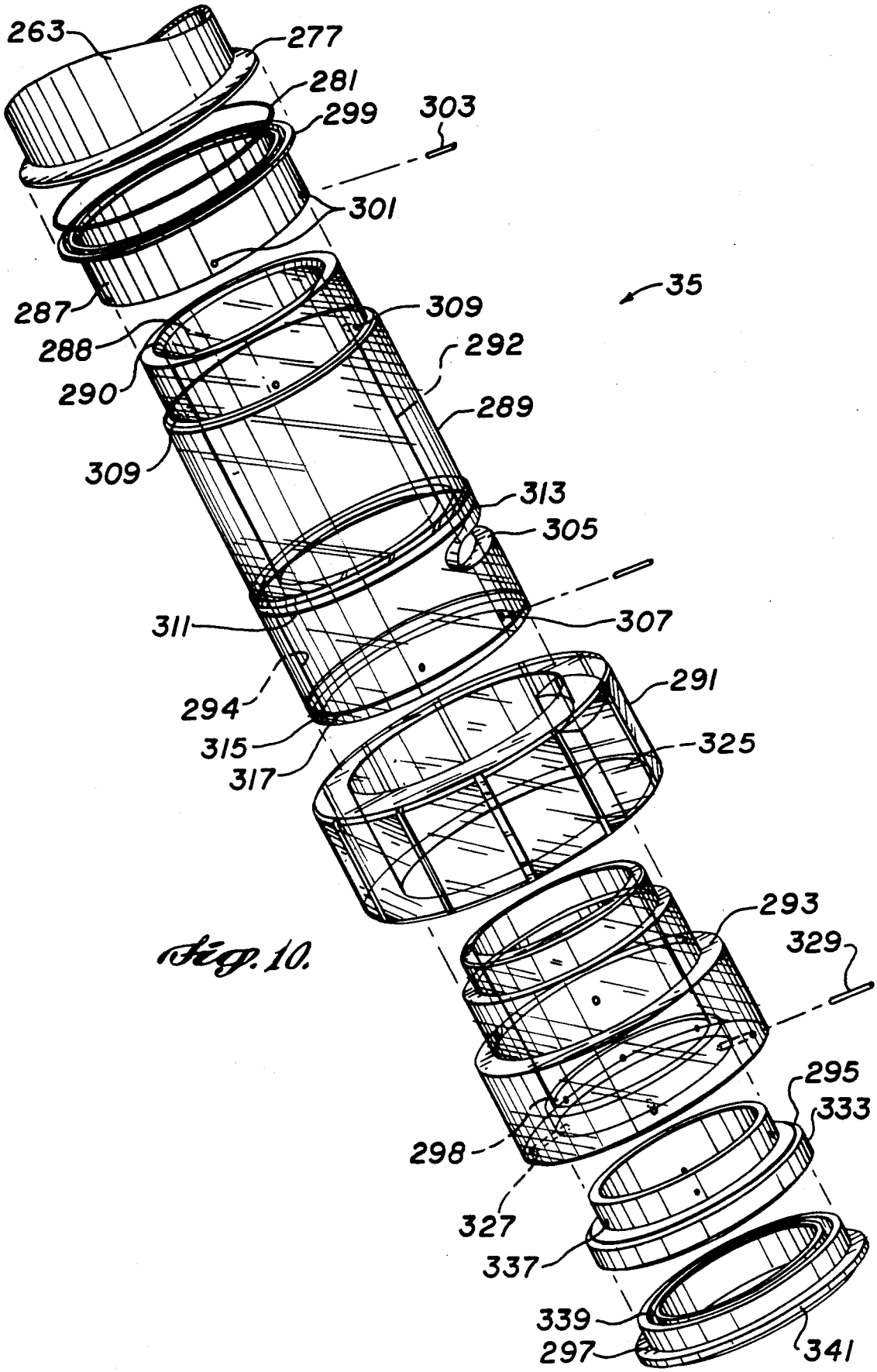
FIG. 10 is an exploded perspective view of the drain subsystem of FIG. 9.
Figure 12:
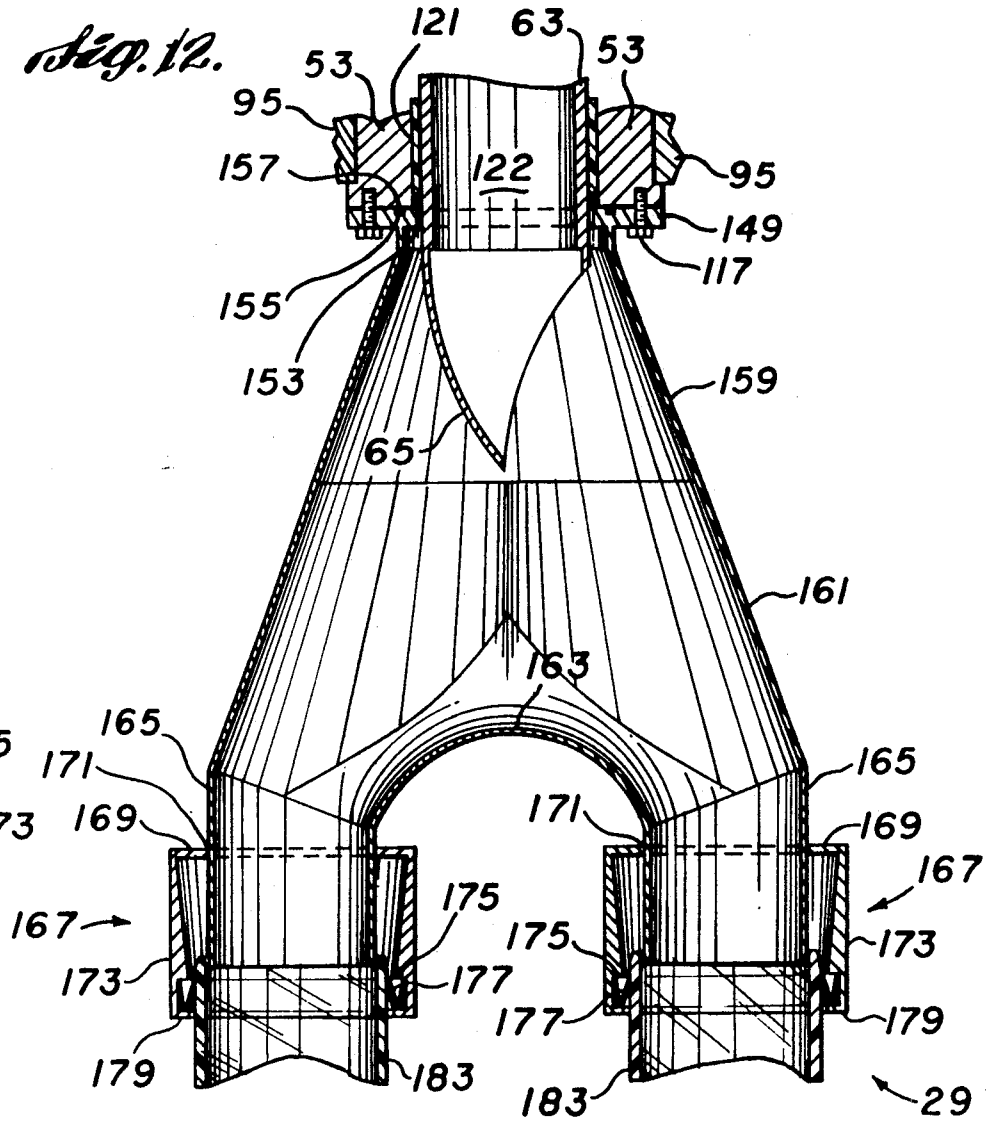
FIG. 12 is a vertical section of the diverter subsystem of FIG. 11 and the bearing tube of the delivery subsystem.
Figure 11:
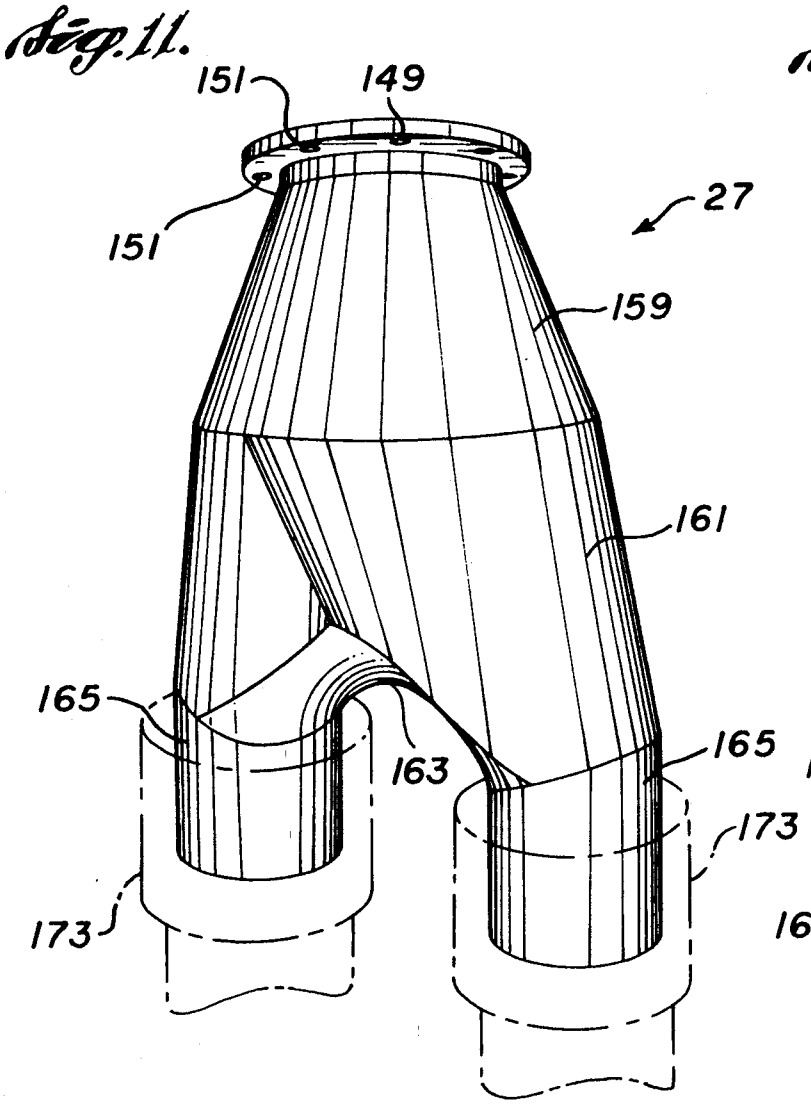
FIG. 11 is a perspective view of the diverter subsystem of the container filling system of FIG. 2.
Figure 13:
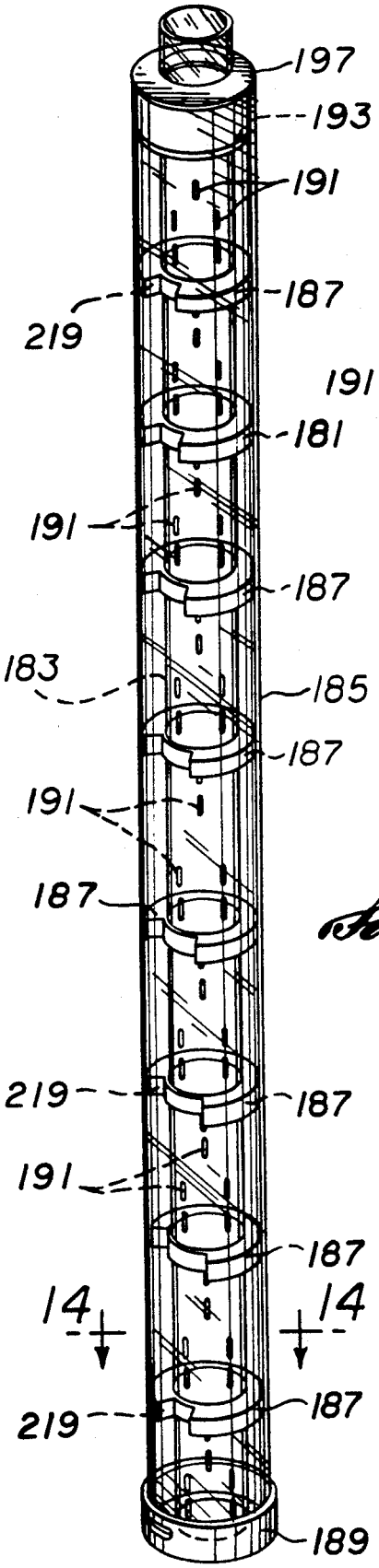
FIG. 13 is a perspective view of one-half of the concentrator subsystem of the container filling system of FIG. 2.
Figure 14:
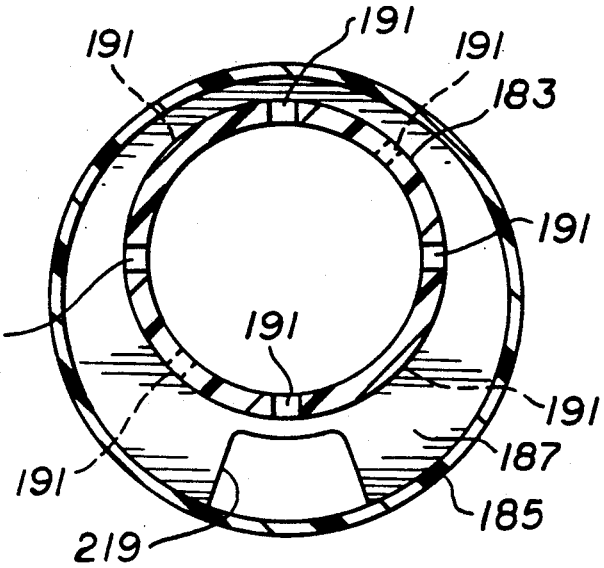
FIG. 14 is a horizontal section view along line 14—14 in FIG. 13.
Figure 15:
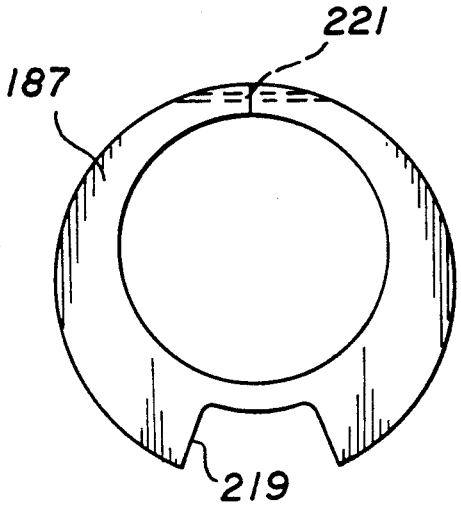
FIG. 15 is a plan view of a flow control ring formed in accordance with the present invention.

Referring to FIGS. 9 and 10, drain subsystem 35 removes the remaining fluid carrier from the filler material and also allows smaller unwanted particles to be removed. Drain subsystem 35 includes six major parts. Ferrule 287, drain top 289, drain cover 291, drain bottom 293, seal holder 295, and seal 297. Each of these elements is generally circular in shape in the illustrated embodiment. When the elements are mated together, they form a bore passing through drain subsystem 35 that has a constant diameter that is substantially equal to the inner diameter of taper liner 261. Accordingly, no additional compression occurs in drain subsystem 35. Each of the individual elements are held together by pins that are placed in pre-drilled pinholes. In the illustrated embodiment, the drain subsystem is made from a clear plastic material.

Ferrule 287 has a short cylindrical body. In the illustrated embodiment, ferrule 287 is approximately one inch high. The top of ferrule 287 includes an outward extending circular flange 299 that mates with flange 277 on the bottom of taper mount 263. Ferrule 287 has an inner diameter slightly greater than the outer diameter of taper liner 261. The two flanges mate together and are secured to each other by clamp 279. The bottom of ferrule 287 includes a plurality of equally spaced holes 301 for receiving pins 303 that allow ferrule 287 to be affixed to the top of drain top 289.

Drain top 289 is generally cylindrical and in the illustrated embodiment is approximately 6½ inches high. The top portion 290 of bore 288 that passes through drain top 289 has a diameter that is substantially equal to the inner diameter of taper liner 261 plus the depth of two grooves 285. Below top portion 290, bore 288 decreases in diameter to a diameter that is substantially equal to the inner diameter of taper liner 261. This middle portion 292 of bore 288 having a constant diameter extends to a point approximately two-thirds of the length of drain top 289. At this point, bore 288 increases in diameter approximately one-half inch and extends to the bottom of drain top 289 forming bottom portion 294 of bore 288. A horizontal oval-shaped passageway 305 passes from the outside of drain top 289 into bottom portion 294 of bore 288. Several pinholes 307 are also drilled from the outside of drain top 289 into bottom portion 294 of bore 288. The top section of drain top 289 has an outer diameter substantially equal to the inner diameter of ferrule 287. The length of this top section is substantially equal to the length of ferrule 287 and includes a plurality of equally spaced pinholes 309. Accordingly, ferrule 289 slides onto and is secured to this portion of drain top 289 using pinholes 301 and 309 and pins 303. Below the top section of drain top 289, the outer diameter of drain top 289 increases. This middle section of drain top 289 extends down to approximately where the diameter of the inner bore 288 increases. Located on the outer surface of drain top 289, at a point just above the point where the diameter of inner bore 288 increases, is channel 311, that acts as a seat for seal 313. Another similar channel 315 is provided just above the bottom of drain top 289 around its periphery and acts as a seat for seal 317. Seals 313 and 317 seal drain top 289 to drain cover 291.

Holes 307 in the bottom section of drain top 289 receive pins 319 that secure drain top 289 to drain bottom 293. Drain bottom 293 is another cylindrical-shaped element that has a central bore 296 passing through its middle having a diameter substantially equal to the inner diameter of taper liner 261. The diameter of bore 296 increases by approximately ½ inch at the bottom ½ inch of drain bottom 293. The outer surface of drain bottom 293 includes three sections of differing outside diameters. The top of drain bottom 293 has an outer diameter that is greater than the inner diameter of taper liner 261, yet less than the inner diameter of the bottom portion 294 of bore 288 in drain top 289. This section of drain bottom 293 has a length that is approximately one-third of the length of bottom portion 294 of bore 288. Below this section of drain bottom 293, the outer diameter increases to a diameter that is substantially equal to the diameter of bottom portion 294 of bore 288 in drain top 289. The remaining section of drain bottom 293 has an outer diameter that is greater than the outer diameter of the bottom of drain top 289 and less than the outer diameter of drain cover 291 that is described below in more detail. This last increase in the outer diameter of drain bottom 293 provides a shoulder upon which the bottom of drain top 289 rests. The combined length of the upper two sections of differing outer diameter of drain bottom 293 is slightly less than the overall length of the bottom portion 294 of bore 288 in drain top 289. Accordingly, when drain bottom 293 is affixed to drain top 289, the top of drain bottom 293 is just below the beginning of the bottom portion 294 of bore 288. Accordingly, a peripheral gap 321 is formed through which fluid carrier and particulate material may escape from bore 288. Since the outer diameter of the upper section of drain top 289 is also less than the diameter of bottom portion 294 of bore 288, a channel 323 having a depth approximately equal to the height of the upper smaller outer diameter section of drain bottom 293 is formed around the periphery of drain bottom 293. Channel 323 collects the escaping fluid carrier and particulate matter and allows it to escape through the oval passage 305 in drain top 289.

A drain cover 291 is provided around the portion of drain subsystem 35 where drain top 289 and drain bottom 293 are joined. Drain cover 291 is a substantially cylindrical element having a bore through its middle that has a diameter substantially equal to the outer diameter of the bottom of drain top 289. The inside surface of drain cover 291 is sealed to the outside surface of drain top 289 by O-rings 313 and 317. An internal chamber 325 is machined into the interior wall of drain cover 291. Internal chamber 325 opens out through the bottom of drain cover 291 and is aligned with oval passage 305. Internal chamber 325 allows fluid carrier and particulate matter that is collected in channel 323 and escapes through passage 305 to be discharged in a downward direction rather than spurting out onto the surrounding area and equipment. Drain cover 291 can be rotated around drain top 289 and drain bottom 293 so that internal chamber 325 does not coincide with passage 305. In this position, drain cover 291 closes off passage 305, a condition that is needed to pressurize the system for start-up.

The bottom of drain bottom 293 includes a short bore 298 having a diameter slightly larger than the inner diameter of taper liner 261. Six holes 327 are drilled from the outside of drain bottom 293 into bore 298. These six holes 327 are spaced at 60° intervals around the circumference of drain bottom 293. These six holes 327 receive pins 329 that secure seal holder 295 to drain bottom 293.

Seal holder 295 is another cylindrical element having a height in the illustrated embodiment of approximately one-half inch. Seal holder 295 includes a bore having a diameter substantially equal to the inner diameter of taper liner 261. Seal holder 295 includes an upper section having an outer diameter that is substantially equal to the inner diameter of bore 298 in the bottom of drain bottom 293. The height of this section of seal holder 295 is substantially equal to the length of bore 298. Accordingly, this section of seal holder 295 fits snugly within bore 298 in drain bottom 293. The outer diameter of seal holder 295 increases below this upper section to a point just slightly above its bottom. This larger portion of seal holder 295 forms an outwardly extending flange 333. Machined into the underside of flange 333 is a square channel 335 that is concentrically located with respect to the central bore passing through seal holder 295. Six holes 337 spaced 60° from each other are drilled between the bore in seal holder 295 and concentric channel 335. As described below in more detail, holes 337 allow air or fluid carrier to enter channel 335 and pressurize it.

Seal 297 of drain subsystem 35 is a flat disc that has a central bore passing through it having a diameter that is substantially equal to the outer diameter of the bottom of seal holder 295. The upper two-thirds of seal 297 has an outer diameter that allows seal 297 to fit snugly within channel 335 provided in the underside of peripheral flange 333. The height of this section of seal 297 is such that when fully retracted into channel 335, the bottom of seal holder 295 will be aligned with the bottom of seal 297. A circumferential channel 339 is provided in the top of seal 297. The lower third of seal 297 includes an outward extending flange 341 whose bottom is beveled upward towards the periphery of seal 297. Seal 297 is designed to be free floating within seal holder 295. Seal 297 is extended against the underlying knife plate 37 when air or fluid carrier passes through small holes 337 in seal holder 295 and into the peripheral channel 335. The primary purpose of seal 297 is for start-up of the system. Seal 297 is designed to prevent fluid carrier that is flowing through the system during start up from escaping the system. If escape of the fluid carrier were not controlled, the system could not be pressurized.

Referring to FIGS. 7, 8 and 9, hub 251 is attached to the underside of lower manifold 145 by bolts 249. Hub 251 includes a central bore that receives drive shaft 343. Hub 251 secures drive shaft 343 using bolts 340. Drive shaft 343 is coupled to main shaft 345 through a two-piece coupler 347 in FIG. 9. Lower manifold 145, with its connection to fluid carrier return tubes 97 and concentrator subsystem 29, transmits rotation from drive shaft 343 to upper rotor 53.

Figure 16:
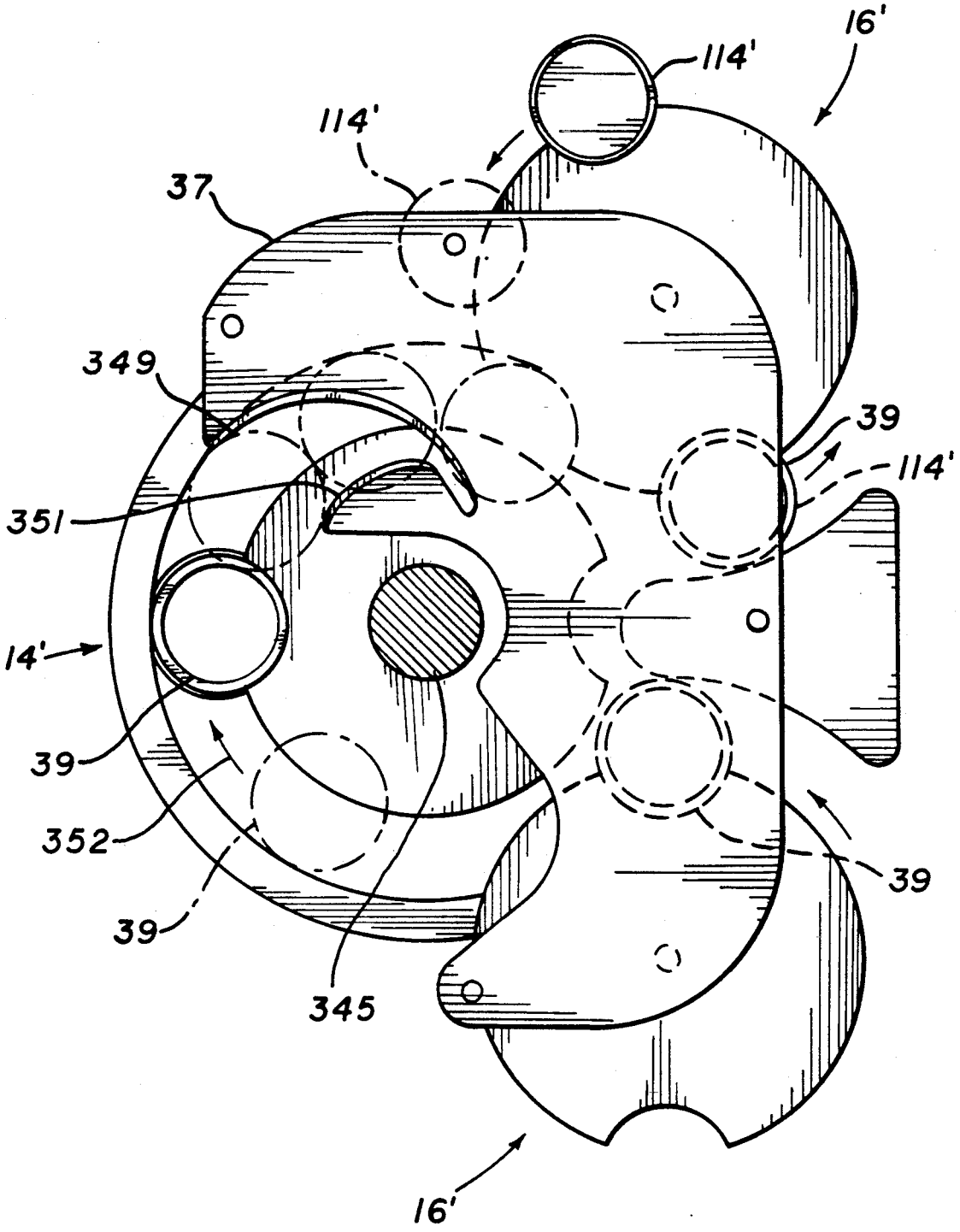
FIG. 16 is a plan view of a knife plate formed in accordance with the present invention.

Referring to FIGS. 2, 9 and 16, as described above, seal 297 floats on knife plate 37 that serves to sever filler material as the drain subsystem 35 rotates. Knife plate 37 also acts as a valve to control when filler material is dispensed into measuring chambers 39 that are rotating beneath knife plate 37 in synchronization with drain subsystem 35. Knife plate 37 includes two cutting edges, a long outside cutting edge 349 and a short inside cutting edge 351, which is in the shape of a cleaver. Long outside cutting edge 349 and short inside cutting edge 351 face each other and are angled towards each other such that the gap between them decreases as the cut of the filler material progresses. Referring particularly to FIG. 16, as measuring chamber 39 moves in the direction of the arrow 352, the long outside cutting edge 349 begins to cut the filler material at its outer surface. At about the same time, short inside cutting edge 351 begins to cut the filler material from its inner boundary. The initial cut made by short inside cutting edge 351 cuts the "problematic last part of the cut" referred to above. As measuring chamber 39 progresses around through the rotation, long outside cutting edge 349 begins to cut through more and more of the filler material. The relative position of long outside cutting edge 349 and the short inside cutting edge 351 are such that the cut of long outside cutting edge 349 overlaps the cut of short inside cutting edge 351 as the rotation progresses. Applicants have found that when the filler material is eviscerated fish, such as whole salmon, clean cuts of salmon without shreds of skin covering the upper portion of the fill or overlapping onto the seal surface of the containers can be achieved when the pressure on the filler material in the direction of dispensing is maintained throughout the cut. Applicants have found that the progression of the cut through the filler material as described above using the knife plate 37 described above and illustrated in FIG. 16, provides clean cuts through whole salmon without premature dulling of the blades.

Referring to FIGS. 2, 3, 17, 18 and 19, after the filler material is severed by knife plate 37, in accordance with the device described in U.S. Pat. Nos. 4,893,660 and 4,961,446, measuring chamber 39 is transferred by transfer subsystem 16' to discharge subsystem 18' where it is aligned vertically with a container 114'. As discharge subsystem 18' rotates, filler material is dispensed into container 114'.

In the past, when the filler material was to be discharged into the container by displacement through the downward motion of plunger 124', air that was in container 114' and that could not be exhausted, would pressurize the container. This made it difficult to quickly introduce the filler material into the container without it "popping" back out. Measuring chamber 39 includes inwardly extending vent bars 353 that provide indentations in the filler material as it is compressed into the measuring chamber 39. These indentations allow air to escape the containers when the cylindrically shaped filler material is plunged into the containers. Measuring chambers 39 formed in accordance with the present invention have an annular body 355 and a radially extending boss 357 that act as a base for measuring chamber 39. Boss 357 includes a plurality of slots 359 in its underside that allows air to enter and exit the inside of measuring chamber 39. Annular body 355 on its inner surface includes two vent bars 353 spaced apart 90°. Vent bars 353 are elongate bars that begin at the bottom of measuring chamber 39 and terminate below the top of measuring chamber 39. Vent bars 353 can have various shapes. In the illustrated embodiment, vent bars 353 are generally rectangular. The upper portion of vent bars 353 is beveled so that filler material does not get caught on vent bar 353 as it is being introduced into measuring chamber 39.

Figure 17:
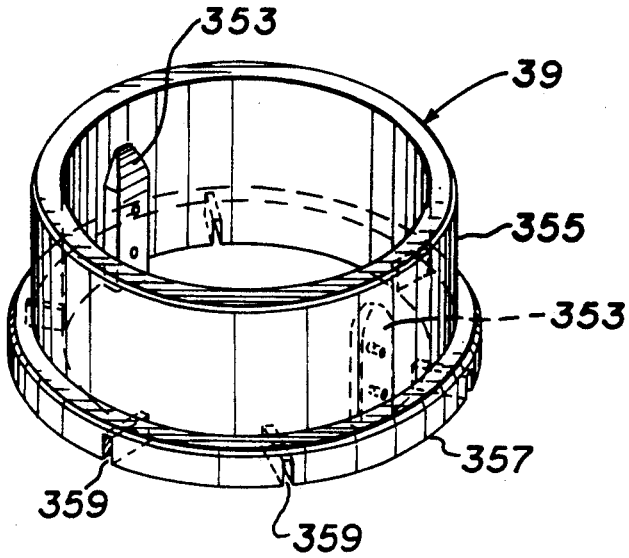
FIG. 17 is a perspective view of a measuring chamber formed in accordance with the present invention.
Figure 18:
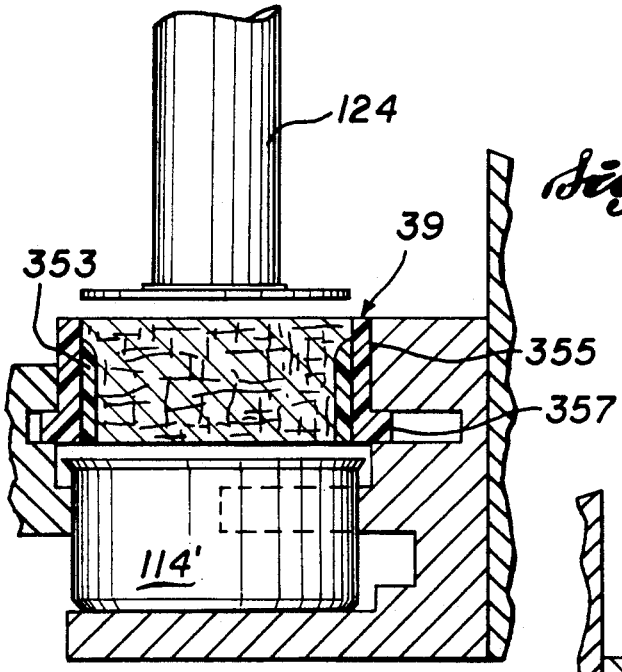
FIGS. 18 and 19 are vertical section views illustrating the operation of the measuring chamber of FIG. 17.
Figure 19:
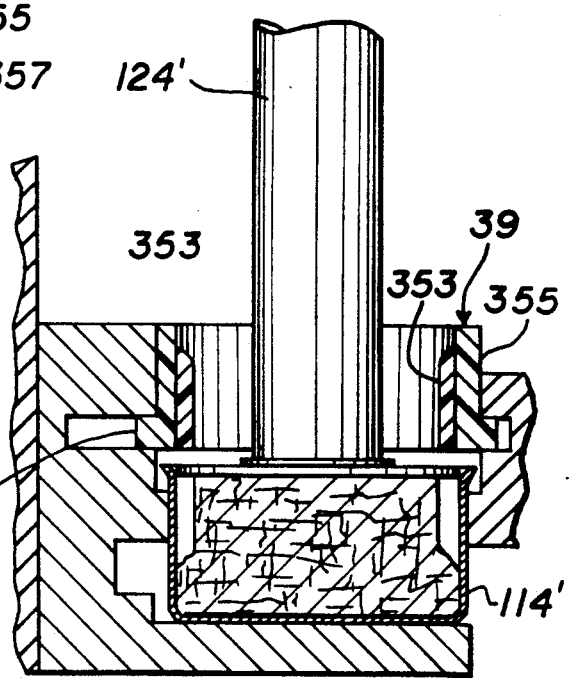

Referring to FIGS. 17 and 18, when filler material is dispensed into container 114' by plunger 124', the indentation formed in the filler material by vent bars 353 provides a passageway for the air in the container to escape. Plunger 124' includes a head 354 that is flexible enough to be deflected by vent bars 353, yet rigid enough to push filler material out of measuring chamber 39 into container 114'. Suitable material for head 354 of plunger 124' includes rubber or plastic. The rubber or plastic heads can be pleated to adjust their flexibility. Accordingly, the filler material may be introduced into the containers in a quick and efficient manner without the filler material popping out.

Turning now to the operation of the system formed in accordance with the present invention, referring to FIGS. 1, 2, and 3 the invention of the present application is intended to provide filler material in a concentrated and uniform pressurized form to a knife plate 37 where it can be cut and dispensed into a measuring chamber 39 which is then transferred to a discharge subsystem 18' by a transfer sybsystem 16' for discharge into a container 114'. The filler material is provided by a delivery subsystem 25 which meters the filler material into a stream of fluid carrier using a combination of a hopper 41, air lock 45, and feed tank 51. The filler material is delivered to a diverter subsystem 27 using a delivery tube 57. Diverter subsystem 27 separates a single stream of filler material and fluid carrier into two separate streams and delivers them to concentrator subsystem 29. Concentrator subsystem 29 includes two elongate concentrators that separate filler material from the fluid carrier and collect the fluid carrier for recycle. The filler material is delivered from concentrator subsystem 29 to taper subsystem 33 which further compresses the filler material. Taper subsystem 33 delivers the filler material to drain subsystem 35 which removes the remaining fluid carrier from the filler material and presents it to knife plate 37 where it is dispensed into measuring chamber 39.

Delivery subsystem 25 includes sensors for determining the amount of filler material in hopper 41, air lock 45, and feed tank 51. The operation of the delivery subsystem 25 is such that it is designed to maintain a given amount of filler material in concentrator subsystem 29. Accordingly, it is preferred that a feedback process control system be established so that the level of filler material in the concentrator subsystem 29 can be determined and relayed back to delivery subsystem 25 where more or less filler material can be introduced into the fluid carrier stream. Because of the speed at which the filler material is being provided, computer-assisted process control is preferred.

The amount of filler material in concentrator subsystem 29 can be detected using the flow control rings 187 described above. The level of filler material in inner tube 183 is determined using a pressure differential calculation. The pressure of carrier fluid entering diverter subsystem 27 can be measured using a conventional monitor. The pressure in the return fluid carrier line 147 can also be monitored to determine the pressure of the fluid carrier in the fluid carrier collection subsystem 31. The fluid carrier will only escape inner tube 183 from slots 191 in those chambers in which filler material has not blocked slots 191. One can determine the ring 187 above the chamber whose slots 191 are blocked by the filler material. The pressure of the fluid carrier in the fluid carrier collection subsystem 31 can be measured as well as the flow rate. As described above, the apertures in the flow control rings 187 are known. Based on standard hydraulic calculations, and assuming that the pressure differential between the diverter subsystem 27 and the return fluid collection subsystem 31 is attributable to the pressure loss as the fluid carrier flows through the aperture in a flow control ring, one can determine what the size of the gap in the flow control ring is and, accordingly, determine which flow control ring is the rate-determining ring. Once this ring is identified, the operator can predict that the filler material is in the chamber that is located beneath such ring. This information can be used to feed back to the delivery subsystem, instructing it to deliver more filler material or less filler material, depending on the process conditions.

Referring to FIGS. 2 and 3, while the discharge subsystem of the present apparatus and the discharge subsystem described in U.S. Pat. No. 4,961,446 are very similar, there are several minor differences. These differences, for the purpose of full disclosure and best mode are described below.

First, in the present invention, there are two measuring chambers 39 being filled per each rotation of the concentrator subsystem 29, accordingly, six discharge stations 110' are required in the discharge subsystem 18'. Although only three discharge stations 110' are illustrated for simplicity in FIGS. 2 and 3, it should be understood that holes 361 in the discharge subsystem hub 363 are for three additional discharge stations 110'. Furthermore, in the system of the present invention, cam 142', along which discharge stations 110' run, is also supported by a vertical support 144' rather than a horizontal support as illustrated in U.S. Pat. No. 4,961,446.

The embodiments of the invention in which an exclusive property or privilege is claimed are defined as follows:

1. An apparatus for introducing solid filler material in a fluid carrier into a measuring chamber, the apparatus comprising:

a diverter subsystem for separating a stream of solid filler material in the fluid carrier into at least two separate streams; and a concentrator subsystem for separating the solid filler material in one of the streams from the fluid carrier and compressing the solid filler material, the concentrator subsystem comprising an elongate inner tube within an elongate outer tube, the inner tube including a first end for receiving solid filler material and fluid carrier from the diverter subsystem and a second end for dispensing the filler material, the inner tube including openings that allow the fluid carrier to escape the inner tube, while maintaining the filler material within the inner tube, the inner tube and the outer tube defining a chamber where fluid carrier that escapes the inner tube is collected.

2. The apparatus of claim 1, wherein the diverter subsystem and the concentrator subsystem rotate about a common axis.

3. The apparatus of claim 1, wherein the inner tube and the outer tube are eccentric.

4. The apparatus of claim 1, wherein the inner tube and the outer tube are oriented vertically with respect to their longitudinal axis.

5. The apparatus of claim 1, further comprising a collection subsystem for collecting the fluid carrier that escapes the inner tube, the collection subsystem including a manifold in fluid communication with the chamber defined between the inner tube and the outer tube.

6. The apparatus of claim 1, wherein the inner tube and the outer tube are cylinders.

7. The apparatus of claim 6, wherein the concentrator subsystem further comprises a plurality of flow control rings placed at predetermined intervals along the length of the inner tube, the flow control rings having an outer diameter equal to the inner diameter of the outer tube, the flow control rings including an aperture having a predetermined cross-sectional area.

8. The apparatus of claim 7, wherein the cross-sectional area of the aperture in the flow control rings is different.

9. The apparatus of claim 8, wherein the size of the aperture in the flow control rings increases for succeeding flow control rings positioned along the inner tube from the first end in the direction of flow of the solid filler material.

10. The apparatus of claim 1, further comprising a taper subsystem attached to the second end of the inner tube, the taper subsystem further compressing the filler material.

11. The apparatus of claim 10, wherein the taper subsystem includes a rigid sleeve that is substantially cylindrical.

12. The apparatus of claim 11, wherein the taper subsystem includes a plastic liner, the liner including a compression section having an inner diameter that decreases from top to bottom and a section of constant diameter below the compression section.

13. The apparatus of claim 12, wherein the section of constant diameter includes longitudinal grooves for allowing fluid carrier to pass through the taper subsystem.

14. The apparatus of claim 10, further comprising a drain subsystem attached to the taper subsystem opposite the inner tube, the drain subsystem including an orifice for allowing fluid carrier and unwanted solids to escape from within the drain subsystem.

15. The apparatus of claim 14, wherein the drain subsystem includes a drain top and a drain bottom, a gap being provided between the drain top and the drain bottom enabling fluid carrier escape from inside the drain subsystem.

16. The apparatus of claim 15, wherein the drain subsystem includes a seal holder attached to the drain bottom that carriers a floating seal, the seal holder and floating seal creating a chamber, the seal holder including an orifice that allows carrier fluid within the drain subsystem to enter and pressurize the chamber.

17. The apparatus of claim 14, wherein the drain subsystem is substantially cylindrical.

18. The apparatus of claim 1, wherein the diverter subsystem includes a single feed port that receives filler material and fluid carrier, and two outlet ports that deliver separate streams of filler material and fluid carrier to separate inner tubes of the concentrator subsystem.

19. The apparatus of claim 18, wherein the diverter is Y-shaped.

20. The apparatus of claim 18, wherein the filler material enters the diverter subsystem through an elbow that deflects the filler material and fluid carrier from a substantially vertical path.

21. The apparatus of claim 1, further comprising a delivery subsystem for introducing the solid filler material into the fluid carrier.

22. The apparatus of claim 21, wherein the delivery subsystem comprises a hopper for accumulating the filler material, a feed tank for selectively introducing the filler material into the fluid carrier, an air lock between the hopper and the feed tank, and a conduit between the feed tank and the diverter subsystem.

23. The apparatus of claim 22, wherein the feed tank includes a flexible rotor that meters the filler material into the fluid carrier, the flexible rotor including a plurality of flexible fingers radiating from the center of the rotor.

24. The apparatus of claim 1, further comprising a knife plate for slicing the filler material after a portion has been introduced into the measuring chamber, the knife plate including a long outside cutting edge and a short inside cutting edge that are positioned to cut the filler material such that the cut made by the long outside cutting edge overlaps the cut made by the short inside cutting edge.

25. The apparatus of claim 24, wherein the long outside cutting edge and the short inside cutting edge are positioned such that they each engage the filler material at substantially the same time.

26. The apparatus of claim 25, wherein the long outside cutting edge and the short inside cutting edge are positioned such that the short inside cutting edge disengages the filler material before the long outside cutting edge.

27. The apparatus of claim 24, wherein the long outside cutting edge and the short inside cutting edge are spaced apart by a distance that decreases as the cut progresses.

28. The apparatus of claim 24, wherein the knife plate includes a portion that prevents the filler material from entering the measuring chamber.

29. The apparatus of claim 1, wherein the measuring chamber includes a top, bottom, and sidewall, the sidewall having an inner surface and an outer surface, the inner surface including a protruding bar that forms an indentation in the filler material as it is packed into the measuring chamber.

30. The apparatus of claim 29, wherein the protruding bar extends from the bottom of the measuring chamber to a point below the top of the measuring chamber.

* * * * *

UNITED STATES PATENT AND TRADEMARK OFFICE

CERTIFICATE OF CORRECTION

PATENT NO. : 5,285,828

DATED : February 15, 1994

INVENTOR(S) : S. Mihail et al.

It is certified that error appears in the above-indentified patent and that said Letters Patent is hereby corrected as shown below:

| COLUMN | LINE | |
|---|---|---|
| 9 | 30 | "bore 127" should read --bore 125-- |
| 11 | 18 | after "and" insert --an-- |
| 22 (Claim 15 | 18 Line 4) | after "carrier" insert --to-- |

Signed and Sealed this

Fifth Day of July, 1994

Bruce Lehman

*Attest:*

BRUCE LEHMAN

*Attesting Officer*

*Commissioner of Patents and Trademarks*